United States Patent [19]

Kuse et al.

[11] Patent Number: 5,028,517

[45] Date of Patent: Jul. 2, 1991

[54] PROCESSING METHOD OF SILVER HALIDE PHOTOGRAPHIC LIGHT-SENSITIVE MATERIAL

[75] Inventors: Satoru Kuse; Masao Ishikawa; Yoshimasa Komatsu; Shigeharu Koboshi, all of Hino, Japan

[73] Assignee: Konica Corporation, Tokyo, Japan

[21] Appl. No.: 353,686

[22] Filed: May 18, 1989

[30] Foreign Application Priority Data

May 23, 1988 [JP] Japan ..... 63-126675
May 26, 1988 [JP] Japan ..... 63-129887
May 26, 1988 [JP] Japan ..... 63-129888

[51] Int. Cl.[5] ..... G03C 5/305

[52] U.S. Cl. ..... 430/434; 430/464; 430/467; 430/484; 430/485; 430/490

[58] Field of Search ..... 430/434, 464, 467, 484, 430/485, 490

[56] References Cited

U.S. PATENT DOCUMENTS

| | | | |
|---|---|---|---|
| 4,374,922 | 2/1983 | Ohbayashi et al. | 430/383 |
| 4,647,528 | 3/1987 | Yamada et al. | 430/567 |
| 4,800,153 | 1/1989 | Morimoto et al. | 430/380 |
| 4,801,516 | 1/1989 | Ishikawa et al. | 430/380 |
| 4,833,068 | 5/1989 | Ohki et al. | 430/484 |
| 4,837,139 | 6/1989 | Kobayashi et al. | 430/542 |

*Primary Examiner*—Charles L. Bowers, Jr.
*Assistant Examiner*—Janet C. Baxter
*Attorney, Agent, or Firm*—Frishauf, Holtz, Goodman & Woodward

[57] ABSTRACT

A method for processing a silver halide color photographic light-sensitive material is disclosed. Fogging caused by the color developer contaminated by heavy metal ions is surpressed by the processing method. The processing method is excellent in the point that stable photographic propertied can be obtained for long while of running. The processing method comprises a step for developing with a color developer an imagewise exposed light-sensitive material which comprises a support and a photographic layer being provided on the support and including at least one silver halide emulsion layer, wherein the photographic layer has a swelling ratio within the range of from 1.5 to 3.5 and the silver halide emulsion layer comprises a silver halide emulsion having a silver chloride content of not less than 90 mole %, and the developing step is performed for a time of not less than 90 seconds with a color developer containing a compound represented by the following Formula (1):

(1)

wherein $R_1$ and $R_2$ are each a hydrogen atom or an alkyl group provided that $R_1$ and $R_2$ are not hydrogen atoms at the same time, and $R_1$ and $R_2$ may be combined to form a ring.

17 Claims, No Drawings

PROCESSING METHOD OF SILVER HALIDE PHOTOGRAPHIC LIGHT-SENSITIVE MATERIAL

FIELD OF THE INVENTION

This invention relates to the processing method of silver halide color photographic light-sensitive materials, more precisely, to the processing method of silver halide color photographic light-sensitive materials which has excellent properties such as lowered fogging in its unexposed part and maintaining a stable processing characteristics for a long period.

BACKGROUND OF THE INVENTION

Ordinarily in a processing method for silver halide color photographic light-sensitive materials to obtain a color picture, the light-sensitive material is exposed image-wise to light and then, developed with color developer to form a color picture by reaction between a p-phenylenediamine series developing agent and a color-picture forming coupler. In this method subtractive color reproduction system is ordinary applied and color picture images of cyan, magenta and yellow are formed on the red-, green- and blue-sensitive layers, respectively. Recently, the high-temperature developing and the simplification of the process are progressing for the purpose to shorten the developing time in this color picture image formation. Especially, the increase of developing speed in color development is highly demanded for the shortening of developing time. Developing speed is affected by two conditions: the silver halide color light-sensitive material and the color developing agent. The composition of silver halide grains in the silver halide emulsion is an important factor in the former and the composition and condition of develop developer are important in the latter.

Hydroxylamine and sulfites are usually used as the preservatives. Especially, hydroxylamine is useful as the preservative of p-phenylene diamine type color developer. However, hydroxylamine has a disadvantage to generate ammonia by decomposition with oxidation. Generated ammonia acts on silver halide color light-sensitive materials and causes ammonia fogging. Decomposition of hydroxylamine is especially accelerated when heavy metal ion such as iron or copper exists in the color developer.

This problem can be avoided by making complex compounds of these heavy metal ions using various kinds of chelating agents. Aminopolycarboxylic acid, polyphosphoric acid and organic phosphoric acid may be usable as the chelating compounds. These chelating agents are effectively used for iron ion but are not very effective for copper ion. Moreover, recently the amount of replenishing liquor tends to decrease economize the developing process and for reducing the amount of waste water. Because of the use of reduced volume of replenishing liquor, the concentration of heavy metals accumulating in the color developer is apt to increase. A way to reduce the effect of the metal ion present in the developer is thus becoming to be important.

On the other hand, a silver halide color light-sensitive material which is mainly composed of silver chloride emulsion (hereinafter, it is called silver chloride color light-sensitive material) is very useful because it has excellent properties such as to be developed quickly and accumulation of bromide and iodide ions both of which suppress the developing reaction is prevented compared to the conventional silver halide emulsions containing silver bromide and iodide (silver-chlorobromide, -chloroiodobromide and -iodobromide emulsions). The present inventors examined this silver chloride color light-sensitive material which is favorable to the quick development and found the following shortcoming. Firstly, hydroxylamine which has been used as the preservative acts as developing agent for silver chloride and progresses the development without color formation resulting in the degradation of coloring density of the finally obtained color image.

Secondly, sulfite salt, which is another preservative, acts as the solubilising agent for silver chloride and it results in the quick progress of physical development while the balance of the silver developing reaction and the coupling reaction is retarded; namely, the silver development goes first and the coupling reaction goes late to the development, such phenomenon causes the degradation of color density.

Thirdly, fogging is easily causable when a heavy metal ion is mixed with the developer. This fogging shows a tendency to increase with the reduced replenishing amount now used in processing as a whole, especially. Furthermore, density of image also shows a tendency to be reduced. The existence of a heavy ion is important problem especially for the continuous processing of large amounts of light-sensitive material.

In case of processing by an automatic developing machine which uses a silver halide color photosensitive material for continuous processing, it is necessary to keep the concentration of the components of color developer in a prescribed range so as to avoid the change of finished properties of the light-sensitive material caused by the change of concentration of components. For this purpose, a replenisher is used so as to supplement the deficient component and to dilute the excess component concentration. With the addition of the replenisher the overflow of the solution is inevitable. This is not favorable from either an economical or pollution-preventive standpoints. So as to cope with the social demand the use of highly-concentrated replenisher to decrease the volume of the overflow as well as the recycling of developer by using electrodialysis process or ion-exchange resin are recommended. This results in a decrease of the supply of replenisher. In such cases, the accumulation of heavy metal ions are unavoidable. It is strongly required to solve the problem of heavy metal effect in the development.

Another drawback was also found. Reduction of the amount of replenisher results the increase of the concentration of color developer because of vaporization of the solution. It causes the difficulty to obtain a good stable photographic characteristics, especially, the maximum density of yellow image. In case of mini-labs, small scale photofinishing workshop, this problem is especially not negligible since discontinuous running treatment is carried out over a long time.

SUMMARY OF THE INVENTION

Object of this invention is to provide a processing method of silver halide color photographic light-sensitive material which causes only little fogging even when heavy metal ions are mixed in the developer and attain stable photographic characteristics for a long while.

The object of the invention is attained by a method for processing a silver halide color photographic light-sensitive material which has been an imagewise exposed and comprises a support and a photographic layer being provided on the support and including at least one silver halide emulsion layer, wherein the photographic layer has a swelling ratio within the range of from 1.5 to 3.5 and the silver halide emulsion layer comprises a silver halide emulsion having a silver chloride content of not less than 90 mole %. The developing step is performed for a time of not less than 90 seconds with a color developer containing a compound represented by the following Formula (1):

Formula (1)

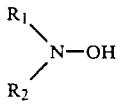

wherein $R_1$ and $R_2$ are each a hydrogen atom or an alkyl group provided that $R_1$ and $R_2$ are not hydrogen atoms at the same time, and $R_1$ and $R_2$ may be combined to form a ring.

DETAILED DESCRIPTION OF THE INVENTION

Compound represented by Formula (I) will be explained. $R_1$ and $R_2$ in formula (I) are independently an alkyl group or hydrogen atom, provided that both of which are not to be hydrogen atoms in the same time. $R_1$ and $R_2$ are allowed to bind to form a ring.

Alkyl groups represented by Formula (I) may be the same as or different from each other. Preferably both of them should be alkyl groups having 1 to 3 carbon atoms. Alkyl group represented by the $R_1$ or $R_2$ can be include a substituted alkyl group. $R_1$ and $R_2$ can be bound to form a ring with each other. Such formed ring includes a heterocyclic ring such as piperadine or morpholine ring. Actual hydroxylamine derivatives represented by Formula (I) are described in U.S. Pat. Nos. 3,287,125, 3,293,034 and 3,287,124. Examples of preferably usable compounds are shown in the table below.

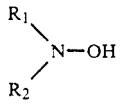

| Exemplified compound No. | $R_1$ | $R_2$ |
|---|---|---|
| A-1 | $-C_2H_5$ | $-C_2H_5$ |
| A-2 | $-CH_3$ | $-CH_3$ |
| A-3 | $-C_3H_7$ | $-C_3H_7$ |
| A-4 | $-C_3H_7$(i) | $-C_3H_7$(i) |
| A-5 | $-CH_3$ | $-C_2H_5$ |
| A-6 | $-C_2H_5$ | $-C_3H_7$(i) |
| A-7 | $-CH_3$ | $-C_3H_7$(i) |
| A-8 | $-H$ | $-C_2H_5$ |
| A-9 | $-H$ | $-C_3H_7$ |
| A-10 | $-H$ | $-CH_3$ |
| A-11 | $-H$ | $-C_3H_7$(i) |
| A-12 | $-C_2H_5$ | $-C_2H_4OCH_3$ |
| A-13 | $-C_2H_4OH$ | $-C_2H_4OH$ |
| A-14 | $-C_2H_4SO_3H$ | $-C_2H_5$ |
| A-15 | $-C_2H_4COOH$ | $-C_2H_4COOH$ |
| A-16 | 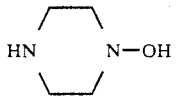 | |

-continued

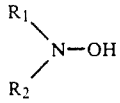

| Exemplified compound No. | $R_1$ | $R_2$ |
|---|---|---|
| A-17 | 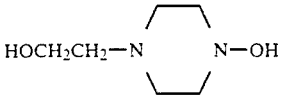 | |
| A-18 | 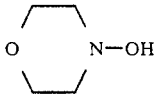 | |
| A-19 | 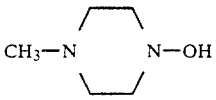 | |
| A-20 | $-CH_3$ | $-C_2H_4OCH_3$ |
| A-21 | $-C_2H_4OCH_3$ | $-C_2H_4OCH_3$ |
| A-22 | $-C_2H_4OC_2H_5$ | $-C_2H_4OC_2H_5$ |
| A-23 | $-C_3H_5OCH_3$ | $-C_3H_6OCH_3$ |
| A-24 | $-C_2H_5$ | $-C_2H_4OC_2H_5$ |
| A-25 | $-C_3H_7$ | $-C_2H_4OCH_3$ |
| A-26 | $-CH_3$ | $-C_2H_4OC_2H_5$ |
| A-27 | $-CH_3$ | $-CH_2OCH_3$ |
| A-28 | $-C_2H_5$ | $-CH_2OC_2H_5$ |
| A-29 | $-CH_2OCH_3$ | $-CH_2OCH_3$ |
| A-30 | $-C_2H_5$ | $-C_2H_4OC_3H_7$ |
| A-31 | $-C_3H_6OC_3H_7$ | $-C_3H_6OC_3H_7$ |

These compounds are used as a free amine, or a salt such as hydrochoride, sulfate p-toluene sulfonate, oxalate, phosphate or acetate.

Applicable concentrations of compounds represented by Formula (I) in the color developer are from $2\times10^{-3}$ mol to $5\times10^{-1}$ mol, preferably, from $5\times10^{-3}$ mol to $3\times10^{-1}$ mol, most preferably, from $1\times10^{-2}$ to $1.5\times10^{-1}$ mol per liter.

Compounds of Formula (I) can be used with the conventional hydroxylamines, glycines described in Japanese O.P.I. Publication 140324/1977, sugars described in Japanese O.P.I. Publication 102727/1977 and α-aminocarbonyl compound described in Japanese O.P.I. Publication 143020/1977 in combination.

Hydroxylamine is preferably used in concentration range of below $1.5\times10^{-1}$ mol and effective to suppress the formation of precipitation or sedimentation in the developer.

In the color developer of the invention, a compound represented Formula (D) is preferably contained. The effect of the invention is displayed more effectively and the oxidation of developing solution can also be effectively prevented if a compound represented by Formula (D) is contained in the developer.

Formula (D)

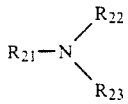

where, $R_{21}$ is a hydroxyalkyl group having 2 to 6 carbon atoms; $R_{22}$ and $R_{23}$ are independently a hydrogen atom, an alkyl group having 1 to 6 carbon atoms, a hydroxyalkyl group having carbon 2 to 6 atoms, a benzyl group or a group represented by

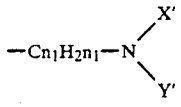

in which $n_1$ is an integer 1 to 6, X' and Y' each are a hydrogen atom, an alkyl group having 1 to 6 carbon atoms or a hydroxyalkyl group having 2 to 6 carbon atoms.

Preferable examples of compounds represented Formula (D) are as follows:

(D-1) ethanolamine
(D-2) diethanolamine
(D-3) triethanolamine
(D-4) di-isopropanolamine
(D-5) 2-methylaminoethanol
(D-6) 2-ethylaminoethanol
(D-7) 2-dimethylaminoethanol
(D-8) 2-diethylaminoethanol
(D-9) 1-diethylamino-2-propanol
(D-10) 3-diethylamino-1-propanol
(D-11) 3-dimethylamino-1-propanol
(D-12) isopropylaminoethanol
(D-13) 3-amino-1-propanol
(D-14) 2-amino-2-methyl-1, 3-propanediol
(D-15) ethylenediaminetetraisopropanol
(D-16) benzyldiethanolamine
(D-17) 2-amino-2-(hydroxymethyl)-1, 3-propanediol These compounds which have Formula (D) are applied on the standpoint of the purpose of this invention with a concentration 1 to 100 g/liter, more preferably 2 to 30 g/liter.

One of the preferable embodiments of this invention is the existence of a bromide as a component of the color developing solution at a concentration of $4\times10^{-4}$ mol per liter or higher. It acts not only to promote the effect of this invention but also to reduce the bleach fogging of unexposed part of light-sensitive material. The applied preferable concentration of the bromide is $8\times10^{-4}$ mol/liter, more preferably, $1.6\times10^{-3}$ to $1.0\times10^{-2}$ mol/liter, most preferably, $3.2\times10^{-3}$ to $8.4\times10^{-3}$ mol/liter.

It is also preferable to use benzyl alcohol in the developer of the invention. Applicable concentration of benzyl alcohol is preferably 0.3 to 10 g/liter more preferably, 0.5 to 5 g/liter, most preferably, 0.7 to 3.5 g/liter of developer.

A chloride is also can be added to the developer at a preferable concentration of $2.0\times10^{-2}$ mol/liter or higher, more preferably, higher than $3.0\times10^{-2}$ mol/liter of developer.

The effect of the existence of a chloride at some concentration is to stabilize the color development since it has a mild inhibitory behavior to a high silver chloride emulsion different from a bromide, lithium, magnesium, potassium or sodium chloride can be used for this purpose. These chlorides may preferably be added in advance in the developer and its concentration preferably maintained at $2.0\times10^{-2}$ mol/liter as the total sum with the chloride dissolving out from the silver chloride emulsion.

The concentration of sulfite in the developer of this invention is preferably not more than $2.0\times10^{-2}$ mol/liter, more preferably, not more than $1.5\times10^{-2}$ mol/liter, most preferably, not more than $1.0\times10^{-2}$ mol/liter.

That is to say, the concentration of sulfite in the developer affects to the color formation density of the color light-sensitive material using a high silver chloride emulsion. Excessively high concentration of sulfite causes decreasing maximum density of color image even when the developing time is extended to a small extent (e.g. 3 minutes and 30 seconds.) It is, therefore, necessary to keep the concentration within the above-mentioned range. The developer of this invention has good preservation properties even when the concentration of sulfite is low. The effectiveness of this invention is exhibited when the concentration of sulfite is low.

Sulfite ion is added as a bisulfite adduct of an aldehyde or a soluble sulfite such as sodium sulfite or potassium sulfite.

The addition of chelating agent to the color developer is preferable in this invention. The degradation of color developer due to contamination with heavy metal can be prevented and the preservativeness is improved with the addition of chelating agent. As preferable chelating agents aminopolycarboxylic acids, organic phosphonic acids and tiron derivatives can be cited. Tiron derivatives are especially effective since they can prevent the formation of the precipitation with calcium or magnesium salt in the color developer.

Above-mentioned aminopolycarboxylic acid is represented by the following Formula (II) and organic phosphonic acid is represented by the Formula (III) or (IV).

Formula (II)

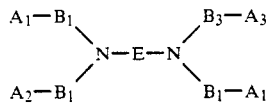

wherein, E is alkylene group, cycloalkylene group, phenylene group, $-B_5-O-B_5-$, $-B_5-O-B_5-O-B_5-$, or $-B_5-Z-B_5-$; Z is

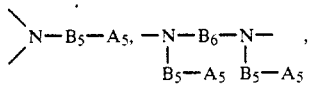

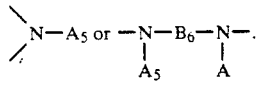

$B_1$ to $B_6$ are each an alkylene group; $A_1$ to $A_3$ are each —COOM or $-PO_3(M)_2$; and $A_4$ and $A_5$ are each a hydrogen atom, a hydroxy group, —COOM or $-PO_3(M)_2$; M is a hydrogen atom or an alkali metal atom.

Formula (III)

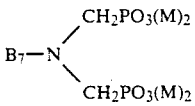

wherein, $B_7$ is an alkyl group, an aryl group or nitrogen-containing six-membered heterocyclic group. M is a hydrogen atom or an alkali metal atom.

Formula (IV)

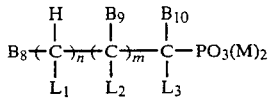

wherein, $B_8$, $B_9$ and $B_{10}$ are each a hydrogen atom, a hydroxyl group, —COOM, $PO_3(M)_2$ or an alkyl group; $L_1$, $L_2$ and $L_3$ are each a hydrogen atom, a hydroxyl group,

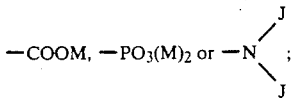

J is a hydrogen atom, an alkyl group, $—C_2H_4OH$ or $—PO_3(M)_2$; M is a hydrogen atom or an alkali metal atom; n and m are each 0 or 1.

Actual examples of chelating agents represented by Formulas (II), (II) or (IV) are shown in the following; chelating agents used in this invention are not limited to these.

Examplified Chelating Agent

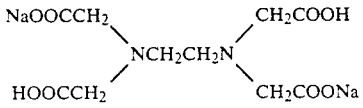

(1)

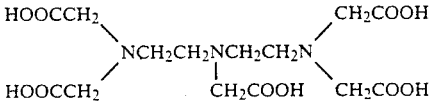

(2)

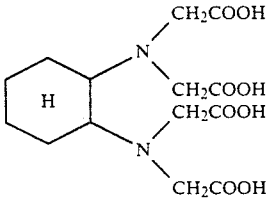

(3)

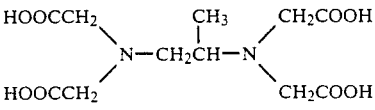

(4)

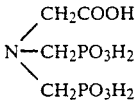

(5)

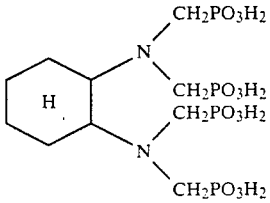

(6)

-continued

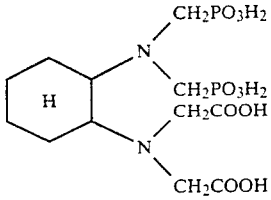

(7)

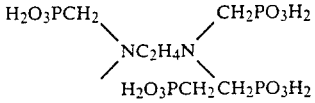

(8)

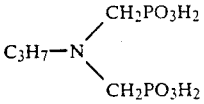

(9)

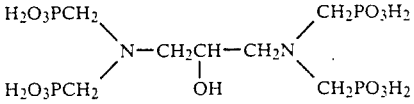

(10)

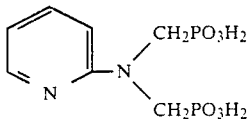

(11)

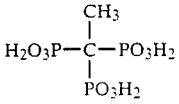

(12)

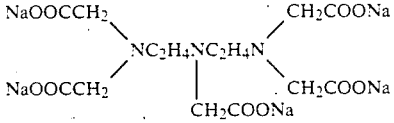

(13)

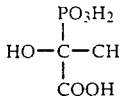

(14)

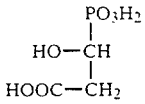

(15)

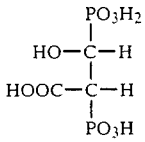

(16)

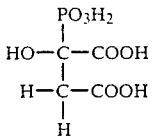

(17)

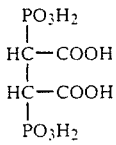

(18)

-continued
(19)
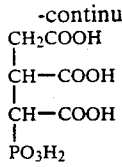
(20)
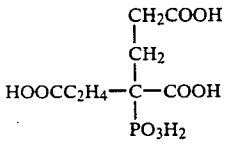
(21)
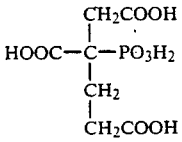
(22)
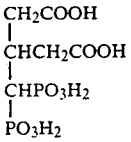
(23)
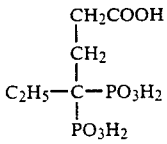
(24)
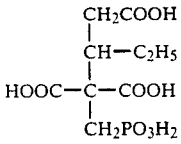
(25)
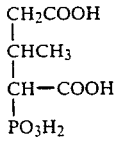
(26)
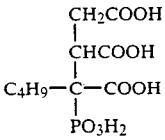
(27)
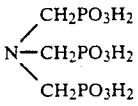
(28)
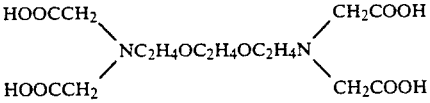
(29)
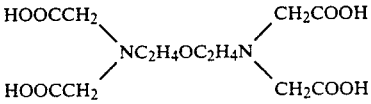
(30)
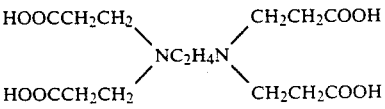
-continued
(31)
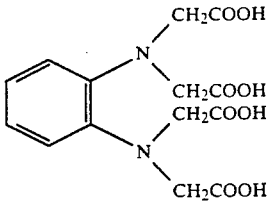
(32)
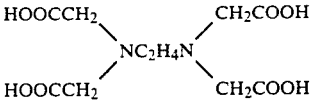
(33)
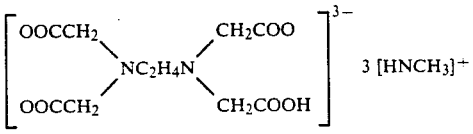
(34)
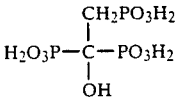
(35)
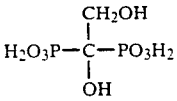
(36)
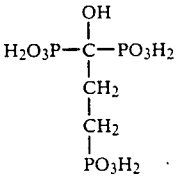
(37)
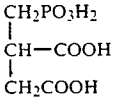
(38)
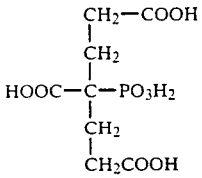
(39)
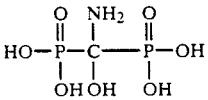
(40)
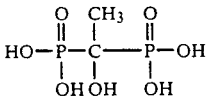
(41)
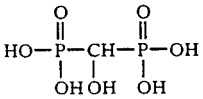
(42)
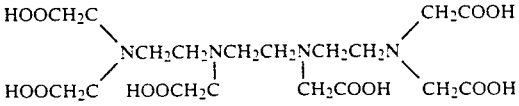

The above-mentioned chelating agents represented by Formulas (II) to (IV) are preferably applicable to the color developer of the invention at a concentration of 0.01 to 100 g/liter, more preferably 0.05 to 50 g/liter, most preferably 0.1 to 20 g/liter.

The above-mentioned tiron derivatives are the compounds represented by Formulas (V) to (VIII).

Formura (V)

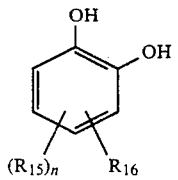

Formula (VI)

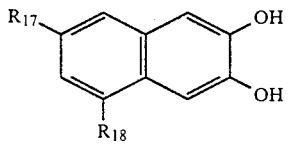

In these formulas, $R_{15}$, $R_{16}$, $R_{17}$ and $R_{18}$ are each a hydrogen atom, a halogen atom, a sulfonic acid group, a substituted or un substituted alkyl group having 1 to 7 carbon atoms, $—OR_{19}$, $—CO—OR_{20}$,

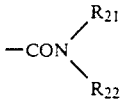

or a substituted or unsubstituted phenyl group; in which $R_{20}$, $R_{21}$ and $R_{19}$, $R_{22}$ are each a hydrogen atom, or an alkyl group having 1 to 18 carbon atoms; n is an integer 1 to 3; $R_{15}$s may be either the same with or different from each other when n is 2 or 3; $R_{15}$ should preferably be sulfonic acid group.

Formula (VII)

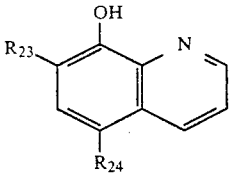

wherein, $R_{23}$ and $R_{24}$ are each a hydrogen atom, a halogen atom or a sulfo group.

Formula (VIII)

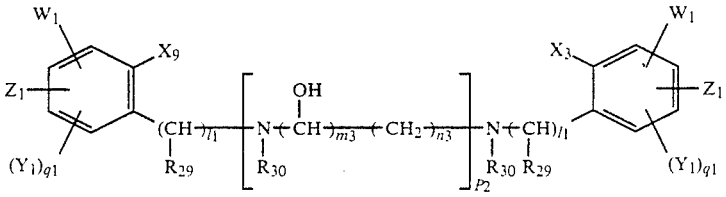

where, $R_{29}$ and $R_{30}$ are each a hydrogen atom, a phosphoric acid group, a carboxy group, $—CH_2$ COOH, $—CH_2$ $PO_3$ $H_2$ or a salt thereof. $X_3$ is a hydroxyl group or its salt; $W_1$, $Z_1$ and $Y_1$ are each a hydrogen atom, a hydroxyl group a cyano group, a carboxy group, a phosphoric acid group, a sulfonic acid group or a salt thereof, a alkoxy group or an alkyl group. m is 0 or 1, n is an integer of 1 to 4, $l_1$ is 1 or 2, $p_2$ is an integer of 0 to 3, and $q_1$ is an integer of 0 to 2.

Actual examples of chelating agents represented by Formulas (V) to (VIII) are as follows:

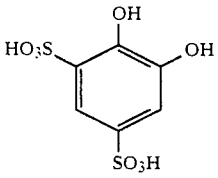

(43)

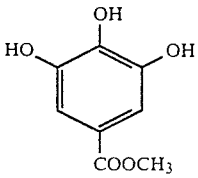

(44)

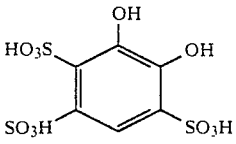

(45)

-continued
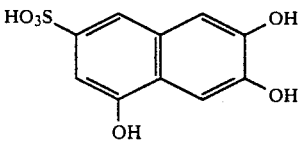
(46)
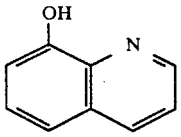
(47)
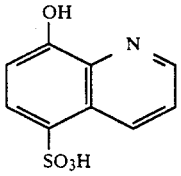
(48)
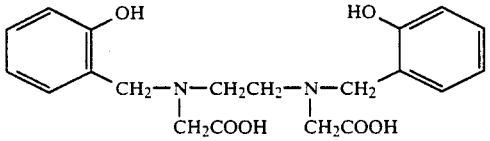
(49)
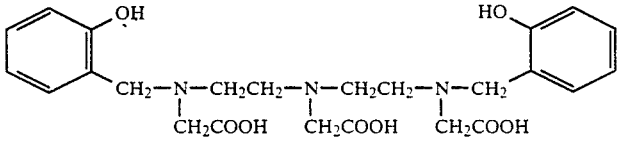
(50)
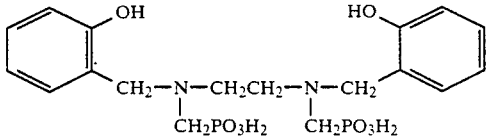
(51)
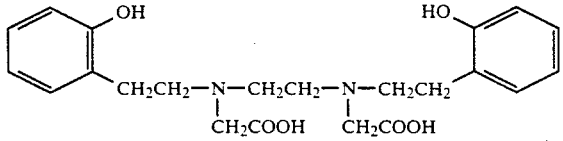
(52)
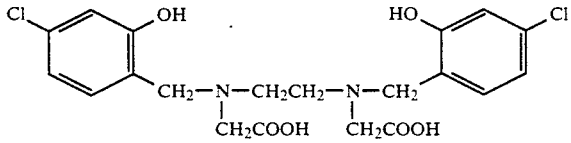
(53)
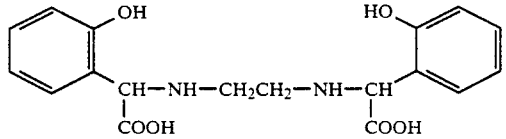
(54)
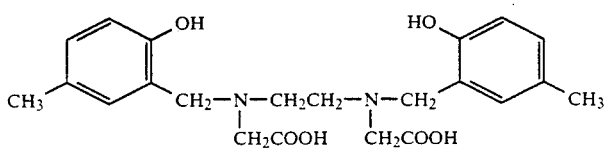
(55)

-continued (56)

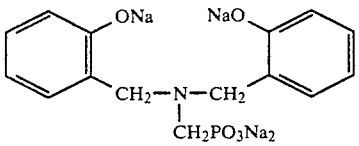

(57)

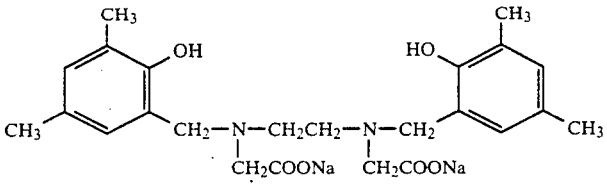

(58)

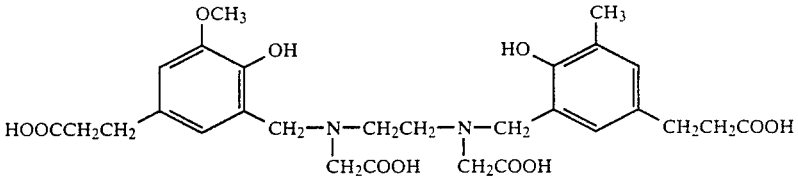

(59)

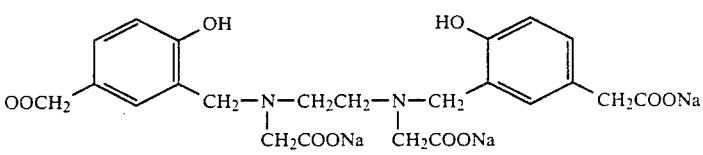

(60)

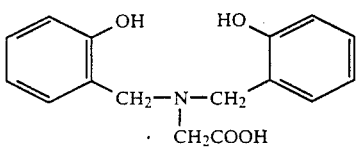

Among these chelating agents represented by Formulas (V) to (VIII), more effective ones are those shown by Formulas (V) and (VIII). Most effective ones are chelating agents having Formula (VIII). Especially, above-mentioned examples (45), (49) and (54) are most preferably used. Two or more kinds of the agents can be used together.

Chelating agents having the general formulas (V)-(VIII) can be added into the color developer of this invention at a concentration within the range of from $1\times10^{-4}$ to 1 mol/liter, more preferably, $2\times10^{-4}$ to $1\times10^{-1}$ mol/liter, the most preferably, $5\times10^{-4}$ to $5\times10^{-2}$ mol/liter.

Color developing agents preferably usable in the color developer of this invention are p-phenylendiamine series compounds having a hydroxyl group which can exhibit a good effect of this invention.

p-Phenylendiamine series compounds having a hydrophilic group have excellent properties which do not easily form stain on light-sensitive materials or produce a rash on the skin compared to p-phenylendiamine series compounds having no hydrophilic group.

At least one of the above-mentioned hydrophilic group should preferably be positioned on the amino group or benzene nucleus in p-phenylendiamine series compounds. Actual examples of the hydrophilic group are as follows:

$-(CH_2)n-CH_2OH$ $-(CH_2)m-NHSO_2-(CH_2)n-CH_3$ $-(CH_2)m-O-(CH_2)n-CH_2$ $-(CH_2CH_2O)nCmH_{2m1}$

—COOH and $-SO_3$ groups, wherein, m and n are each an integer 0 or larger.

Preferable examples of color developing agent are as follows:

Examples of color developing agents (1)

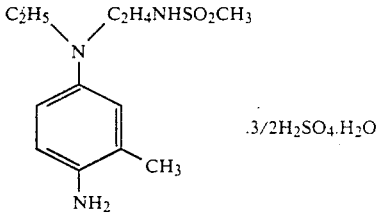

$.3/2H_2SO_4.H_2O$ (2)

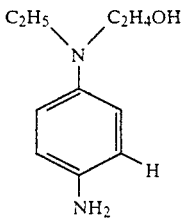

$.H_2SO_4$

-continued
(3)
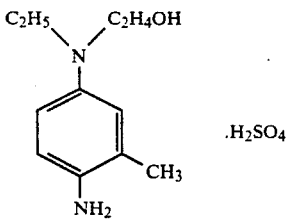
(4)
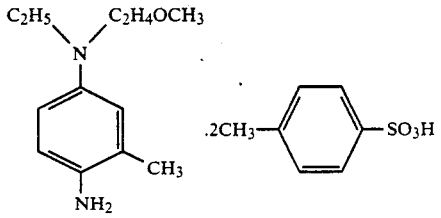
(5)
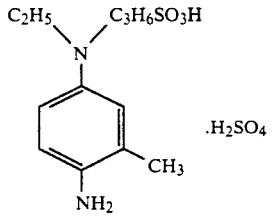
(6)
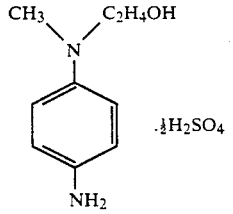
(7)
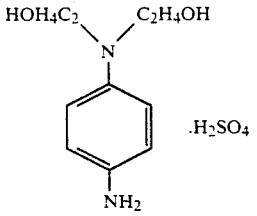
(8)
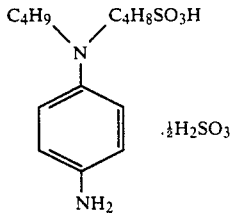
(9)
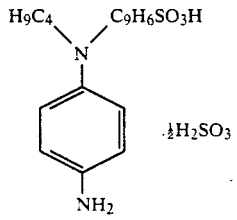
-continued
(10)
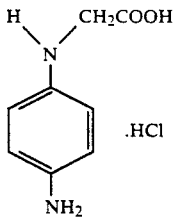
(11)
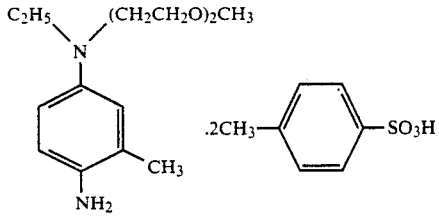
(12)
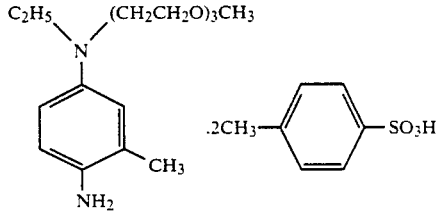
(13)
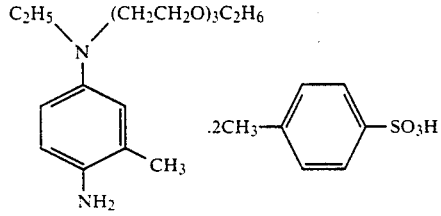
(14)
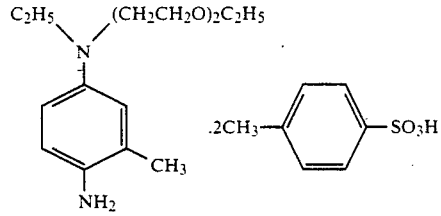
(15)
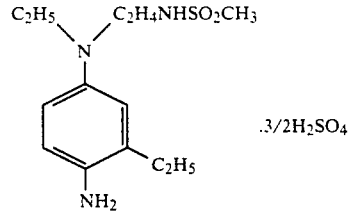
(16)
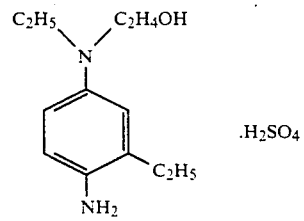
These color developing agents are ordinarily used as a form of their salt such as hydrochloride, sulfate, or p-tolune-sulfonate. Their applicable concentrations are preferably within the range of $1\times10^{-3}$ to $2\times10^{-1}$ mol/l liter of color developer and it should be preferable within a range $1.5\times10^{-3}$ to $2\times10^{-1}$ mol/liter of color developer on the stand point of quick processing.

The following materials can be added to the color developer in this invention other than the above-mentioned components.

As alkalizing agent, for example, sodium carbonate, potassium carbonate, sodium hydroxide, potassium hydroxide, silicates, sodium metaborate, potassium metaborate, sodium tertiary phosphate, potassium tertiary phosphate and boric acid can be used either singly or with combination.

Other compounds are also usable for the purpose of preparation convenience or to increase the ionic strength of the solution such as disodium hydrogenphosphate, dipotassium hydrogenphosphate, sodium bicarbonate, potassium bicarbonate and borates.

Organic and inorganic fog inhibitors can also be used if necessary.

Various developing-accelerating agents are also usable if necessary, such as pyridinium compounds described in U.S. Pat. Nos. 2,648,604, 3,671,247, Japanese Patent Examined Publication 9503(1969); other cationic compounds, cationic dye such as phenosafran, neutral salts such as thallium nitrate; polyethylene glycol and its derivatives described in U.S. Pat. Nos. 2,533,990, 2,531,832, 2,577,127 and Japan Patent Examined Publication 9504(1969); nonionic compounds such as polythioethers; organic solvents described in Japanese Patent Examined Publication 9509(1969); benzyl alcohol and phenethyl alcohol described in U.S. Pat. No. 2,304,925; acetylene glycol, methyl ethyl ketone, cyclohexanone, thioethers, pyridines, ammonia, hydrazine and amines.

Organic solvents which can increase the solubility of developing agents such as ethylene glycol, methyl cellosolve, methanol, acetone, dimethyl formamide, β-cyclodextrine and others which are shown in Japanese Patent Examined Publication 33378(1972) and 9504(1969).

Supplementary developing agents are also usable together with the developing agent such as N-methyl-p-aminophenol sulphate (methol), phenidone, N, N-diethyl-p-aminophenol hydrochloride and N, N, N', N'-tetramethyl-p-phenylenediamine hydrochloride. Their preferable adding amount is usually 0.01 to 10 g/liter. Moreover, various additives can be used if necessary such as competing coupler, fogging agent, colored coupler, so-called DIR-coupler, which release development-inhibitor and other development-inhibitor-releasing compounds.

Other various additives such as antistaining agent, sludg-inhibitors and interlayer effect accelerators are also usable.

The use of triazilstilbene type fluorescent whitening agent is preferable in the color developer of this invention for the purpose to prevent the formation of tar. Compounds represented by Formula (IX) is preferable for this purpose.

Formula (IX)

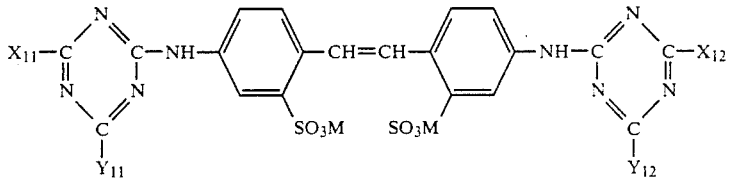

wherein, $X_{11}$, $X_{12}$, $Y_{11}$ and $Y_{12}$ are each a hydroxyl group; halogen atom such as chlorine or bromine; a morpholino group, an alkoxy group such as methoxy, ethoxy, and methoxyethoxy group; an aryloxy radical such as phenoxy and p-sulfophenoxy group; an alkyl group such as methyl and ethyl group; an aryl group such as phenyl and methoxyphenyl group; an amino group, an alkylamino group such as methylamino, ethylamino, propylamino, dimethylamino, cyclohexylamino, β-hydroxyethylamino, di(β-hydroxyethyl) amino, β-sulfoethylamino, N-(β-sulfoethyl)-N'-methylamino and N-(β-hydroxyethyl-N'-methylamino group; an arylamino anilino, o-, m-, p-sulfoanilino, o-, m-, p-chloro-anilino, o-, m-, p-toluidino, o-, m-, p-carboxyanilino, o-, m-, p-hydroxyanilino, sulfonaphthylamino, o-, m-, p-aminoanilino, o-, m-, and p-anisidino, group.

M is a hydrogen atom, a sodium, potassium, or lithium atom or an ammonium group.

Actual examples are as follows. However, the compound is not limited to these.

Examplified compound (1)

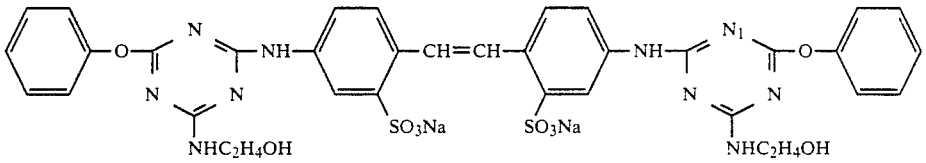

(2)

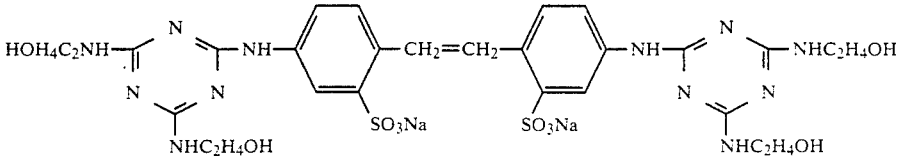

-continued
(3)
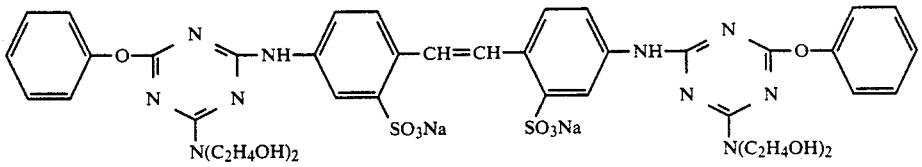
(4)
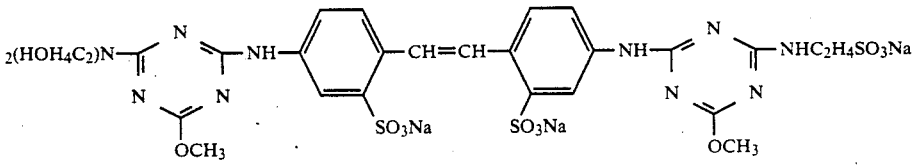
(5)
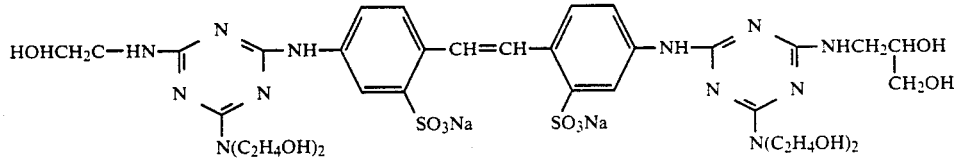
(6)
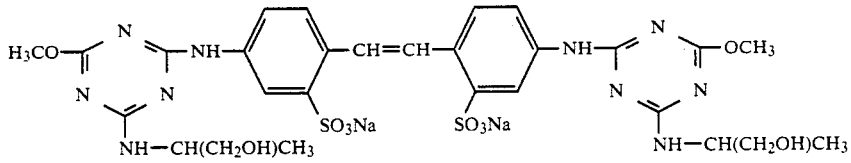
(7)
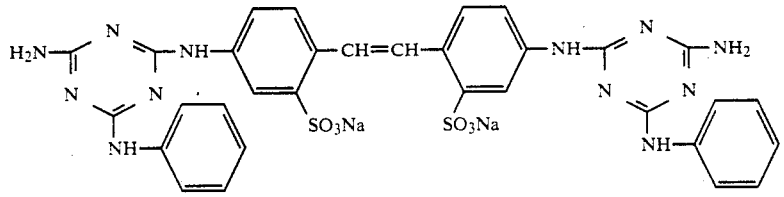
(8)
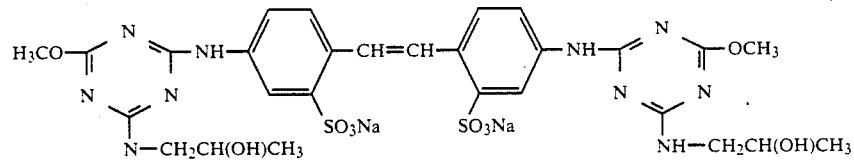
(9)
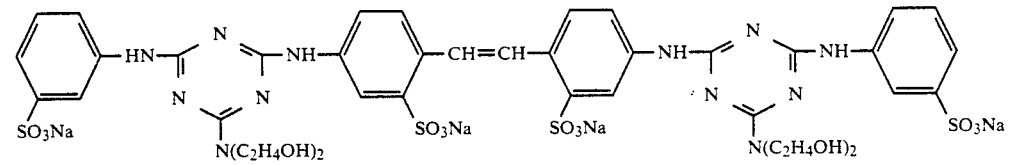
(10)
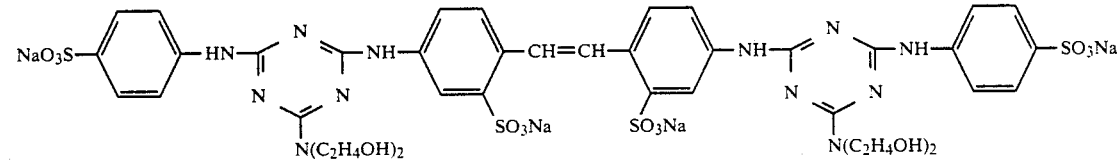
(11)
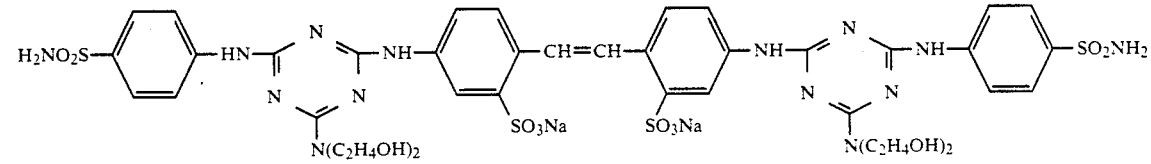

-continued (12)

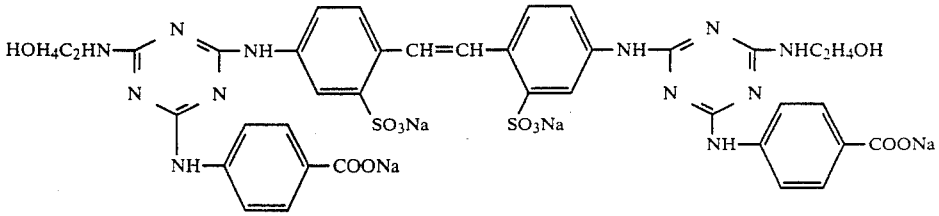

(13)

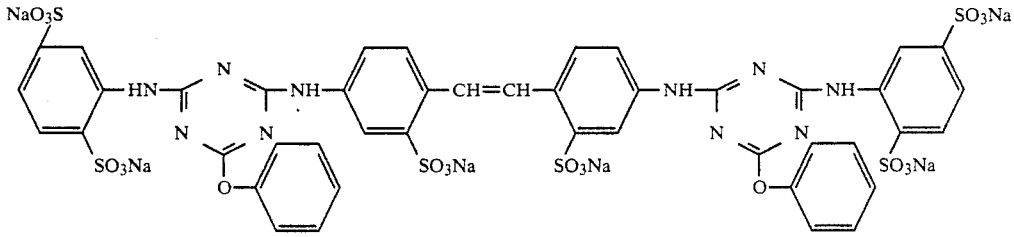

(14)

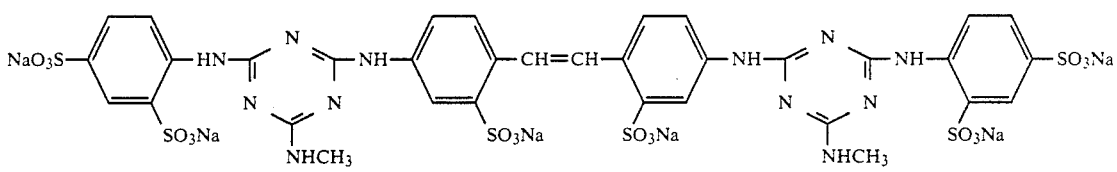

The above-mentioned triazilstilbene whitening agent can be synthesized with the usual method shown in p.5 of "Fluorescent whitening agent" edited by Kaseihin Kogyo Kyokai (Synthetic Chemicals Industry Association) 1976.

This triazilstilbene whitening agent are usable with a concentration of 0.2 to 20 g/liter of color developer of this invention, more preferably, within the range of 0.4 to 10 g/liter.

The developer can be prepared by adding the above-mentioned components in water successively and being agitated. Components slightly soluble in water can be applied after being dissolved in an above-mentioned organic solvent such as triethanol amine. And more generally, it can be prepared after arranging two or more components which are mixable in a stable state each other into concentrated solutions or solid state in small containers and then adding them to water and agitating.

Although the developer of the invention can be used at any pH range, preferable pH range is 9.5 to 13.0 on the standpoint of rapid processing, more preferably it is 9.8 to 12.0.

Replenishing amount of developer in this invention is preferably 10 to 300 ml/1 $m^2$ of light-sensitive material for the purpose to exhibit the good effect of this invention, more preferably it is 30 to 100 ml.

Time for treatment of the color developing of this invention is longer than 90 seconds, more preferably, it is 00 to 360 seconds, and the most preferably 150 to 40 seconds.

In this invention, bleach-fixer is preferably used after the color development on the to obtain rapid processing. In the case that a high silver chloride light-sensitive material is used and bleach-fixing treatment is applied just after the color development as in this invention, a stain called bleaching fog is liable to occur. After various examination, it is found that this fogging can be prevented by the use of the bleach-fixer at a pH within the range of from 4.5 to 6.8; this method also has a desirable effect to accelerate the bleaching rate of silver. This effect is more preferable by the treatment at a pH range of 5 to 6.3.

Amount of replenisher for the bleach-fixer in this invention is preferably not higher than 200 ml, more preferably, 15 to 180 ml and most preferably 30 to 150 ml per square meter of silver halide color light-sensitive material. If the amount is lower than 15 ml, the surface level of solution is lowered by vaporization resulting decrease of bleach and fixing abilities and considerable increase of stain.

When the above-mentioned replenishing amount increases to more than 200 ml/$m^2$ of silver halide color light-sensitive material the effect of this invention hardly be realized. The effect of the invention is favorably obtained when this amount is not more than 150 ml.

Metal complex salts of organic acids are preferably usable as the bleaching agent in the bleach-fixer of this invention. The metal complex salts act to oxidize the metal silver formed by development of silver halide and, simultaneously, to make coloring the non colored part of the color forming coupler. The chemical structure of such metal complexes is the complex coordinating a metal ion such as iron, cobalt or copper with an organic acid such as aminopolycarboxylic acid, oxalic acid or citric acid. Organic acid usable for this purpose are polycarboxylic acid and aminopolycarboxylic acids. Alkali-metal salts, ammonium salts or water soluble amine salts of these polycarboxylic or aminopolycarboxylic acids are also usable.

The following compound can be cited actual examples.

(1) Ethylenediaminetetraacetic acid
(2) Diethylenetriaminepentaacetic acid
(3) Ethylenediamine-N-(β-oxyethyl)-N, N', N'-triactic acid
(4) Propylenediaminetetraacetic acid
(5) Nitrylotriacetic acid
(6) Cyclohexanediaminetetraacetic acid
(7) Iminodiacetic acid (8) Dihydroxyethylglycinecitric acid or tartaric acid
(9) Ethylether diaminetetraacetic acid
(10) Glycolether aminotetraacetic acid
(11) Ethylenediaminetetrapropionic acid
(12) Phenylenediaminetetraacetic acid
(13) Disodium ethylenediamine tetraacetate
(14) Tetra (trimethyl ammonium) ethylenediaminetetraacetate
(15) Tetrasodium ethylenediaminetetraacetate
(16) Pentasodium diethylenetriaminepentaacetate
(17) Sodium ethylenediamine-N-(β-oxyethyl)-N-N', N'-tetraacetate
(18) Sodium propylenediaminetetraacetate
(19) Sodium nitrylotriacetate
(20) Sodium cyclohexanediaminetetraacetate The bleaching solution can also contain such various additives together with the above-mentioned metal complex salt of organic acids as bleachers as a rehalogenating agent such as alkali halides or ammonium halides, for example, potassium bromide, sodium bromide, sodium chloride or ammonium bromide; metal salts and chelating agent.

Other additives such as buffering agent, e.g. borates, oxalates, carbonates or phosphates, or other materials such as alkyl amines or polyethylene oxides, which are known as ordinary additives for bleaching solution, can be added to the bleaching solution.

More over, in the fixer and bleach-fixer of the invention one or more kinds of pH-buffer composed of the following salts for example, can be contained various sulfites such as ammonium sulfite, potassium sulfite, sodium bisulfite, ammonium metabisulfite, potassium metabisulfite, sodium metabisulfite; boric acid, borax, sodium hydroxide, potassium hydroxide, sodium carbonate, potassium carbonate, sodium bicarbonate, potassium bicarbonate, acetic acid, sodium acetate, and ammonium hydroxide.

When the treatment is carried out by continuously adding the replenisher, thiosulfate, thiocyanate or sulfite can be contained in the bleach-fixing bath or can be added in the replenisher for replenishing to the bleach-fixing bath.

For enhancing the activity of bleaching solution or bleach-fixing solution, the blowing of air or oxygen into the bleach-fixing bath or the storage tank of the replenishing solution, or the addition of an oxidizing agent such as hydrogen perioxide, a bromate or a persulfate can be carried out.

Preferable pH value of the bleach-fixer in this invention is within the range of from 3.0 to 9.0; more preferably, in the range of 4.0 to 8.0. Bleach-fixing time is not shorter than 10 seconds; or not shorter than 20 seconds, preferably. For the purpose to display the effect of this invention, the time is longer, such as 50 seconds or more, the better.

Silver can be recovered from the fixer and bleach-fixer solutions which contain soluble silver complex by known methods. Various methods can be applied effectively such as electrolytic method described in French Patent 2,299,667, precipitation method described in Japanese Patent Publication open to Public Inspection, hereinafter referred to as Japanese Patent O.P.I. Publication No. 73037(1977), German Patent No. 2,331,220, ion-exchange method described in Japanese Patent O.P.I. Publication No. 17114(1976), German Patent No. 2,548,237, and metal replacing method described in British Patent No. 1,353,805.

After the color-developing treatment using the color developer of this invention and successive bleach-fixing, stabilizing treatment is carried out either accompanying previous water-washing or not. For stabilizing treatment, the stabilizing solution can be used either after ion-exchange resin treatment or electrodialysis. Additional treatment can be applied such as hardening, neutralizing, black-and-white developing, reversal developing and washing with small amount water, if they are required. Typical examples of preferable treatment procedure are shown as following:

(1) Color-developing—bleach-fixing—washing
(2) Color-developing—bleach-fixing—washing with small amount of water—washing
(3) Color-developing—bleach-fixing—washing—stabilizing
(4) Color-developing—bleach-fixing—stabilizing
(5) Color-developing—bleach-fixing—first stabilizing—second stabilizing The color developer of this invention is applicable for color light-sensitive material such as color paper, color film, color positive film, color positive paper, colorreversal film for slide, color reversal film for movies, color reversal film for TV and reversal color paper.

In the processing of the invention, the object of the invention, namely decreasing of replenisher, improved desilverization and stable processing can be achieved when the silver chloride content in light-sensitive materials is not lower than 90%, or, more preferably, not lower than 95%.

The crystal form of the silver halide grains usable in this invention is either regular, twin orthotropic or any others. The ratio between (100) and (111) faces can be chosen arbitrary. Crystal structure of inside and out side of the silver halide grain may be either uniform or layered, core-shell type structure, in which inside and outside of the grain has different composition. Either the silver halide grains making the latent image mainly on the surface or those making the latent image inside of the grains are applicable. Tabular-type silver halide grains (Japanese Patent O.P.I. Publication Nos. 113934(1983) and 47959(1986) are also applicable.

The above-mentioned silver halide grains should preferably be mono-dispersed type, which can be prepared by acid, neutral and ammoniacal methods.

Standard deviation of the grain distribution of mono-dispersed emulsions can easily be obtained since their grain size distribution of mono-dispersed emulsion almost indicates normal distribution. Then, the width of distribution is defined from equation:

$$\frac{\text{Standard deviation}}{\text{Mean diameter}} \times 100 = \text{Width of distribution (\%)}$$

Preferable distribution of the monodispersed type emulsion calculated from this equation should be not higher than 20%; more preferably, not higher than 10%. The diameter in this equation means the diameter of spherical silver halide grains, and it should be calculated by conversing it to the sphere having the same projection area if the grain is not spherical.

The preparation of silver grains is carried out by making the seed grain at first by the acid method and then it is made to grow to the proper size with the ammoniacal method by which the seed grain can be rapidly grown. To grow the silver halide grains, it is preferable to control the pH and pAg in the reaction vessel and to add and mix silver ion and halide ion simultaneously with the amounts comparable to the growing speed of the halide grain as shown in Japanese Patent O.P.I. Publication No. 48521(1979).

The silver halide emulsion of this invention can be sensitized with various kinds of sensitizer such as active gelatin; sulfur sensitizers such as aryl thiocarbamide, thiourea, cystine; selensensitizer; reduction sensitizer such as a stanrous salt, thiourea dioxide, and polyamines; precious-metal sensitizers such as gold sensitizers, e.g. potassium aurithiocyanate, potassium chloroaurate, 2-aurothio-3-methyl benzothiazolium chloride, water-soluble salts of ruthenium, palladium, platinum, rhodium and iridium, e.g. ammonium chloropalladate, potassium chloroplatinate and sodium chloropalladate (some of these compounds are usable either for sensitizer or fogging inhibitor according to their applied concentration). These sensitizers are usable either singly or in combination of more than two of them. For example, a combination of gold sensitizer and sulfur sensitizer or a combination of gold sensitizer and selenium sensitizer.

The silver halide emulsion is chemically ripened with addition of a sulfur-comtaining compound. At least one of hydroxytetrazaindene compound and at least one of nitrogen-containing heterocyclic compound having mercapto group can be added applicable either before, during or after the chemical ripening of the emulsion.

The silver halide emulsion can be optically sensitized by adding a sensitizing dye of $5\times10^{-8}$ to $3\times10^{-3}$ mol per mol of silver halide to give sensitivity to a desirable wave length region. Various kinds of sensitizing dyestuffs are applicable either singly or in combination.

Preferable light-sensitive material applicable to this invention is one which has red-sensitive silver halide emulsion layer, blue-sensitive silver halide emulsion layer and green-sensitive silver halide sensitive layer each containing the respective coupler, namely a compound capable of forming a dye by reaction with the oxidation product of a color developing agent.

As yellow couplers, the following couplers are usable: closed-ketomethylene compounds; so-called 2 equivalent-type couplers such as active-site o-aryl substituted coupler, active-site o-acryl substituted coupler, active-site hydantoin compound substituted coupler, active-site urazloe compound substituted coupler and active-site succinimide compound substituted coupler, active-site fluorine substituted coupler, active-site chlorine or bromine substituted coupler and active-site o-sulfonyl substituted coupler. As actual examples of usable yellow couplers, ones described in U.S. Pat. Nos. 2,875,057, 3,265,506, 3,408,194, 3,551,155, 3,582,322, 3,725,072, 3,891,445; German Patent Nos. 1,547,868, 2,219,917, 2,261,361, 2,414,006, British Patent No. 1,425,020; Japanese Patent O.P.I. Publication Nos. 10783(1976), 26133(1972), 73147(1973), 102636(1976), 6341(1975), 123342(1975), 130442(1975), 21827(1976), 87650(1975), 82424(1977), 115219(1977), and 95346(1978) can be cited.

As usable magenta couplers, compounds of pyrazolone, pyrazolotriazole, pyrazolino-benzoimidazole and indazolone series can be cited. Either 2-equivalent type and 4-equivalent couplers are also usable same as the case of yellow couplers. Actual examples of magenta couplers are shown in U.S. Pat. Nos. 2,600,788, 2,983,608, 3,062,653, 3,127,269, 3,311,476, 3,319,391, 3,519,429, 3,558,319, 3,582,322, 3,615,506, 3,834,908, and 3,891,445, German Patent No. 1,810,464, German Patent (OLS) Nos. 2,408,665, 2,417,945, 2,418,959, and 2,424,467, Japanese Patent Examined Publication No. 6031(1965), Japanese Patent O.P.I. Publication Nos. 20826(1976), 58922(1977), 129538(1974), 74027(1974), 159336(1975), 42121(1977), 74028(1974), 60233(1975), 26541(1976), 55122(1978) and 110943(1980). Especially preferable magenta couplers are ones represented by the following Formula (M-I), which can be effectively used for making color light sensitive materials protected from influences of processing condition variation and yellow stain formation.

In the structure of the magenta coupler represented by the previously mentioned Formula (M-I), below;

Formula (M-I)

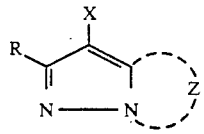

Z represents an atomic group necessary for forming a nitrogen-containing heterocycle, where the so-formed heterocycle may have a substituent.

X represents a hydrogen atom; or a group that is capable of being split off by reaction with an oxidation product of a color developing agent.

R represents a hydrogen atom, or a substituent group.

The substituent group represented by R is not particularly limited but is typically any of the following groups, namely, alkyl, aryl, anilino, acylamino, sulfonamide, alkylthio, arylthio, alkenyl, and cycloalkyl groups. Other examples include a halogen atom; cycloalkenyl, alkynyl, heterocyclic, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imide, ureide, sulfamoylamino, alkoxycarbonylamino, aryloxy carbonylamino, alkoxycarbonyl, aryloxy carbonyl, and heterocyclic thio groups; and spiro residue and bridged hydrocarbon residue.

The alkyl group represented by R is preferably any of those having 1 to 32 carbon atoms, and may be straight-chained or branched.

The aryl group represented by R is preferably a phenyl group.

The examples of the acylamino group represented by R include alkylcarbonylamino and arylcarbonylamino groups.

The examples of the sulfonamide group represented by R include alkylsulfonylamino and arylsulfonylamino groups.

The examples of the alkyl and aryl components in the alkylthio and arylthio groups represented by R are alkyl and aryl groups each represented by R.

The alkenyl group represented by R is preferably one having 2 to 32 carbon atoms; and cycloalkyl group represented by R is favorably one having 3 to 12, more favorably 5 to 7 carbon atoms; the alkenyl group may be straight-chained or branched.

The cycloalkenyl group represented by R is favorably one having 3 to 12 carbon atoms, more favorably 5 to 7 carbon atoms.

The examples of the sulfonyl group represented by R include alkylsulfonyl and arylsulfonyl groups.

The examples of the so-represented sulfinyl group include alkylsulfinyl and arylsulfinyl groups.

The examples of the so-represented phosphonyl group include alkylphosphonyl, alkoxyphosphonyl, aryloxyphosphonyl, and arylphosphonyl groups.

The examples of the so-represented acyl group include alkylcarbonyl and arylcarbonyl groups.

The examples of the so-represented carbamoyl group include alkylcarbamoyl and arylcarbamoyl groups.

The examples of the so-represented sulfamoyl group include alkylsulfamoyl and arylsulfamoyl groups.

The examples of the so-represented acyloxy group include alkylcarbonyloxy and arylcarbonyloxy groups.

The examples of the so-represented carbamoyloxy group include alkylcarbamoyloxy and arylcarbamoyloxy groups.

The examples of the so-represented ureide group include alkylureide and arylureide groups.

The examples of the so-represented sulfamoylamino group include alkylsulfamoyl amino and arylsulfamoyl amino groups.

The so-represented heterocyclic group is preferably five- to seven-membered one, and the examples of the five-to seven membered one include 2-furil, 2-thienyl, 2-pyrimidinyl, or 2-benzothiazolyl group.

The so-represented heterocyclic oxy group is preferably one having a five- to seven-membered heterocyclic ring, and typically, 3,4,5,6-tetrahydropyranyl-2-oxy group or 1-phenyl-tetrazole-5-oxy group.

The so-represented heterocyclic thio group is preferably a five- to seven-membered heterocyclic thio group, for example, 2-pyridylthio, 2-benzothiazolylthio, or 2,4-di-phenoxy-1,3,5-trizole-6-thio group.

The examples of the so-represented siloxy group include trimethylsiloxy, triethylsiloxy, and dimethylbutylsiloxy groups.

The examples of the so-represented imide group include succinimide, 3-heptadecyl succinimide, phthalimide, and glutarimide groups.

The examples of the so-represented spiro residue include spiro [3,3] heptane-1-yl.

The examples of the so-represented bridged hydrocarbon residue include bicyclo [2,2,1] heptane-1-yl, tricyclo [3,3,1$^{3,7}$] decane-1-yl, and 7,7-dimethyl-bicyclo [2,2,1] heptane-1-yl.

The examples of the group that is represented by X and is capable of being split off by reaction with an oxidation product of the color developing agent include halogen atoms (e.g., chlorine, bromine, and fluorine atoms); alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, arylthio, heterocyclic thio, alkyloxythio carbonylthio, acylamino, sulfonamide, N-atom bonded nitrogen-containing heterocycle, alkyloxycarbonylamino, aryloxycarbonylamino, carboxyl, and

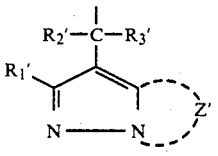

(wherein $R_1'$ is synonymous with the previously defined R; Z', synonymous with the previously defineds; and $R_2'$ and $R_3'$ independently represent a hydrogen atom, or aryl, alkyl, or heterocyclic group). Among these examples, however, a particularly preferred one is a halogen atom, especially, chlorine atom.

The examples of the nitrogen-containing heterocyclic ring formed by Z or Z' include pyrazole, imidazole, triazole, and tetrazole rings. For the substituent groups which any of these rings may have, those mentioned with respect to the previously defined R are available.

The couplers represented by General Formula (M-I) are more specifically represented by the following Formula (M-II) through (M-VII):

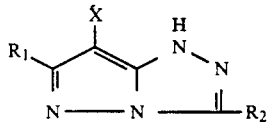

Formula (M-II)

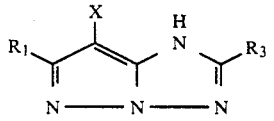

Formula (M-III)

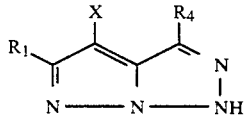

Formula (M-IV)

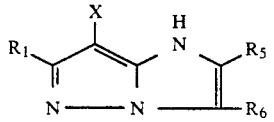

Formula (M-V)

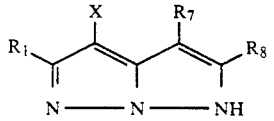

Formula (M-VI)

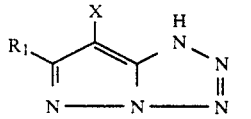

Formula (M-VII)

In Formulas (M-II) through (M-VII) above, $R_1$ through $R_8$ and X are synonymous with the previously mentioned R and X.

Among the couplers expressed by Formula (M-I), the particularly preferred are those expressed by the following Formula (M-VIII).

Formula (M-VIII)

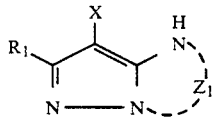

In this formula, $R_1$, X, and $Z_1$ are synonymous with R, X, and Z in Formula (M-I).

Of the magenta couplers previously expressed by Formulas (M-II) to (M-VII), the most advantageous are those expressed by Formula (M-II).

As the substituent which a ring formed by Z in Formula (M-I), or a ring formed by $Z_1$ in Formula (M-VIII), may have, or as any of $R_1$ through $R_8$ in Formulas (M-II) through (M-VI), those expressed by the following Formula (M-IX) are particularly preferred.

Formula (M-IX)

$$-R^1-SO_2-R^2$$

In the formula, $R^1$ represents an alkylene group, and $R^2$ represents an alkyl group, a cycloalkyl group, or an aryl group.

The alkylene group represented by $R^1$ has a straight chain portion having preferably 2 or more carbon atoms, in particular, 3 to 6 carbon atoms, and may be of either straight chained or branched configuration.

As the cycloalkyl group represented by $R^2$, a five- or six-membered one is preferred.

If the light-sensitive material is used for positive image formation, the particularly preferable substituent groups R and $R_1$ on the previously mentioned heterocyclic ring are those represented by the following Formula (M-X).

Formula (M-X)

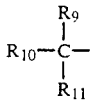

In the formula, $R_9$, $R_{10}$, and $R_{11}$ are synonymous with aforesaid R.

Two of above mentioned $R_9$, $R_{10}$, and $R_{11}$, for example, $R_9$ and $R_{10}$, may be interlinked together to form a saturated or unsaturated ring (e.g., cycloalkane, cycloalkene, or heterocycle), and further, $R_{11}$ may be combined with the ring to form a bridged hydrocarbon residue group.

With Formula (M-X), it is preferable that (i) at least two of $R_9$ through $R_{11}$ are alkyl groups, or that (ii) one of $R_9$ through $R_{11}$, for example, $R_{11}$ is a hydrogen atom, wherein the other two i.e. $R_9$ and $R_{10}$ are interlinked together to form cycloalkyl in conjunction with a bridgehead atom.

Further, in the above case (i), it is preferable that two of $R_9$ through $R_{11}$ are alkyl groups, while the other one is a hydrogen atom or an alkyl group.

If the light-sensitive material of the invention is used for negative image formation, the particularly preferable substituent groups R and $R_1$ on the above mentioned heterocycle are those represented by the following Formula (M-XI).

Formula (M-XI)

$$R_{12}-CH_2-$$

$R_{12}$ in this formula is synonymous with aforesaid R.

$R_{12}$ is preferably a hydrogen atom, or an alkyl group.

The typical examples of the compounds according to the invention are as follows.

1

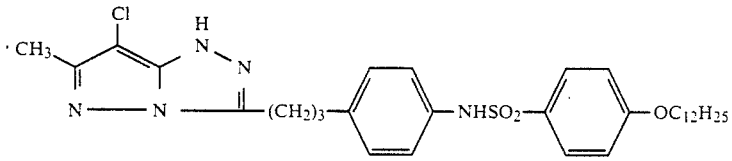

2

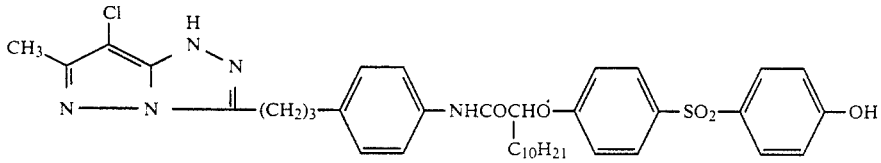

3

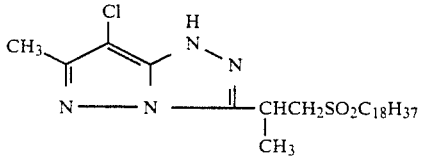

4

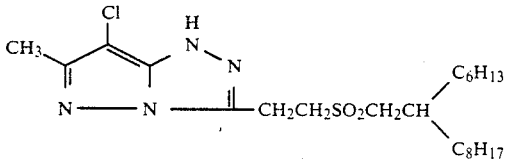

5

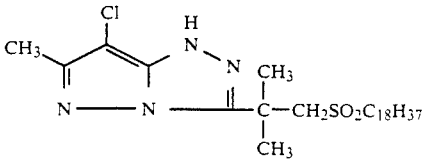

-continued
6
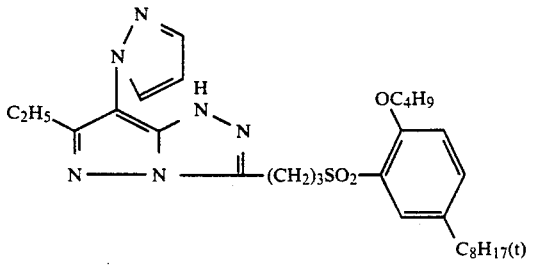
7
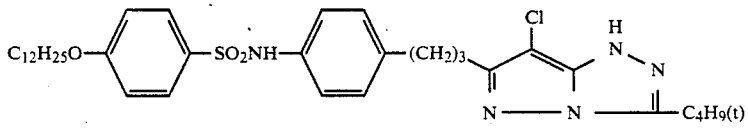
8
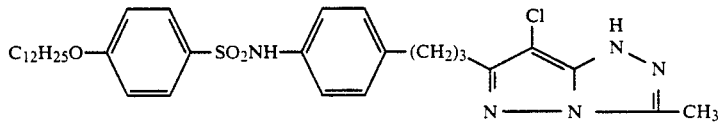
9
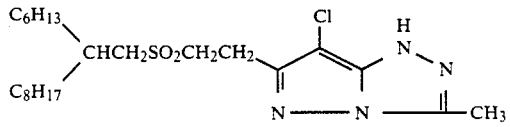
10
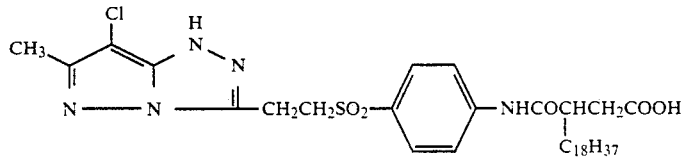
11
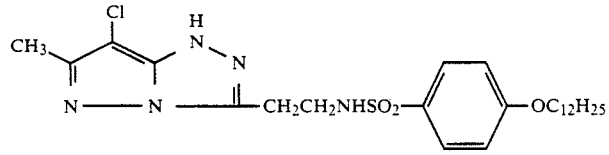
12
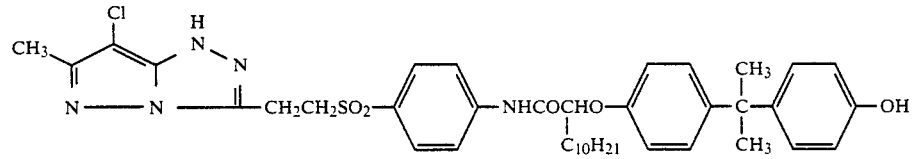
13
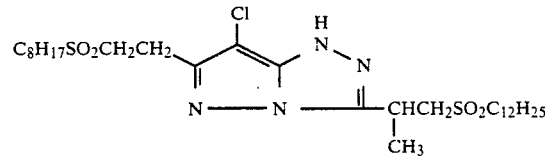
14
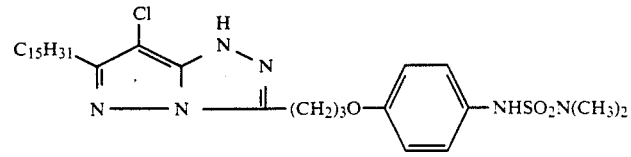

-continued
15
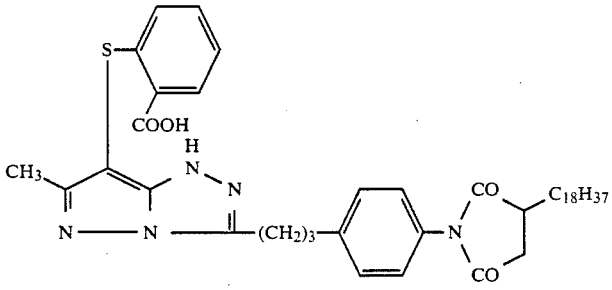
16
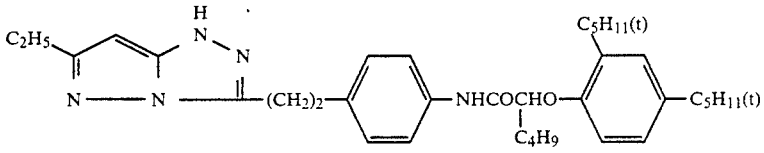
17
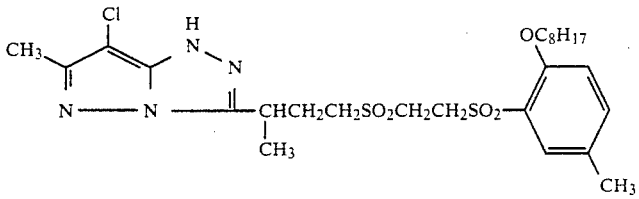
18
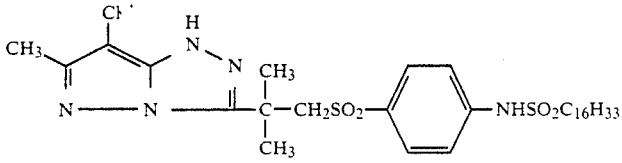
19
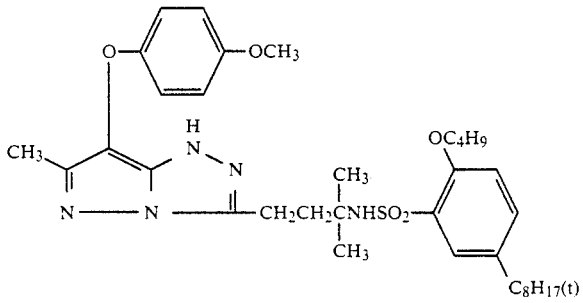
20
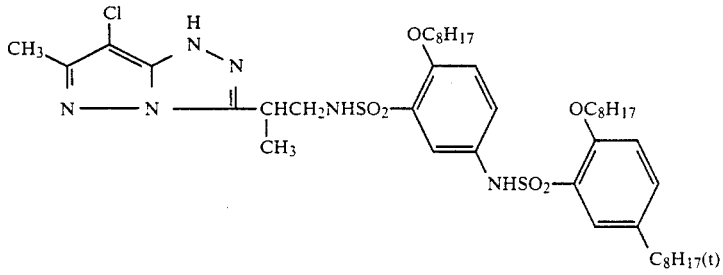
21
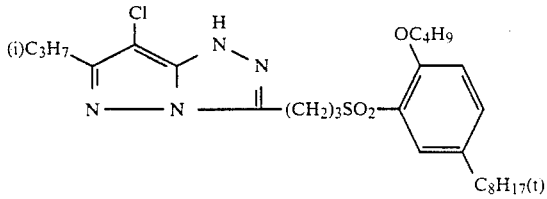

-continued
22
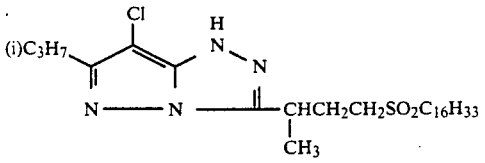
23
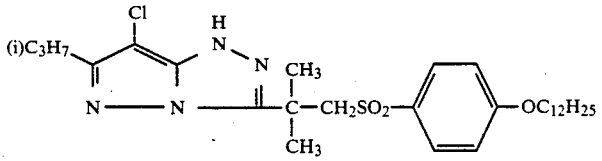
24
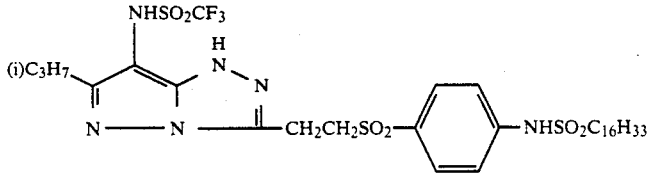
25
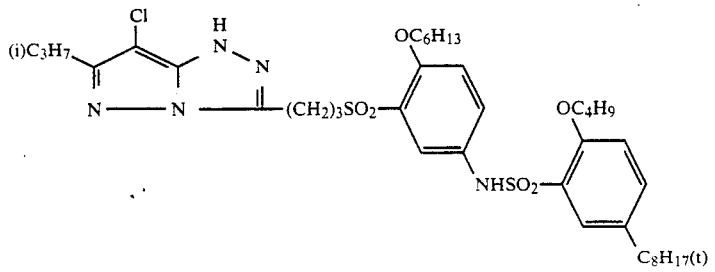
26
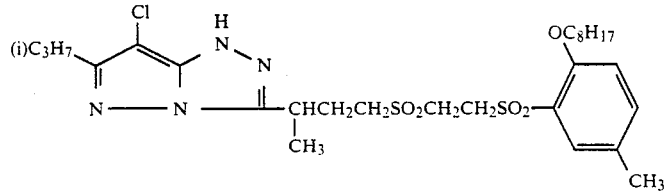
27
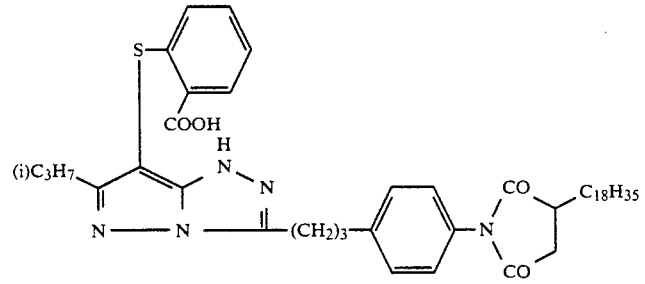
28
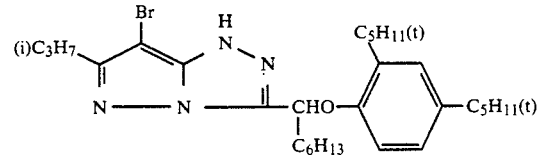
29
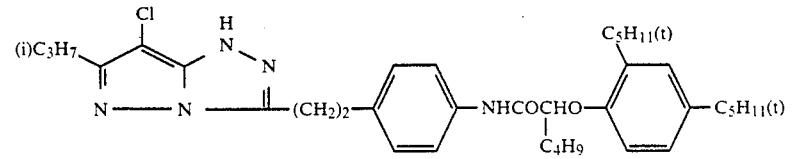

-continued
30
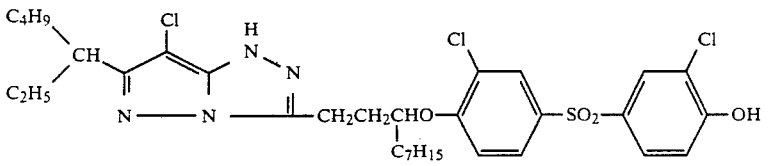
31
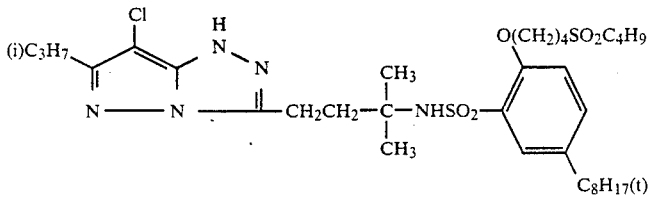
32
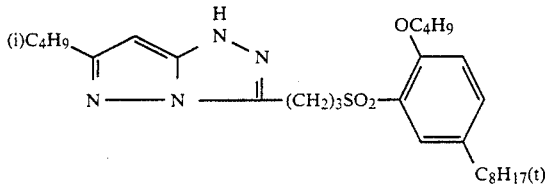
33
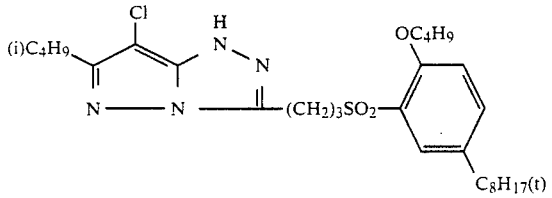
34
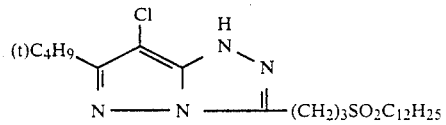
35
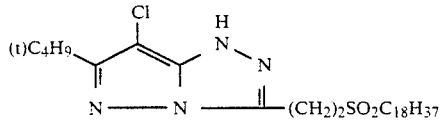
36
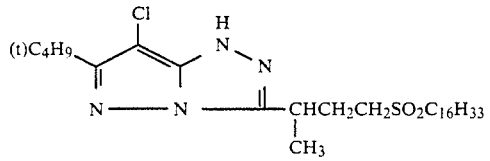
37
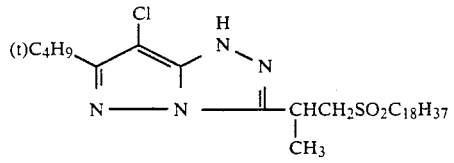
38
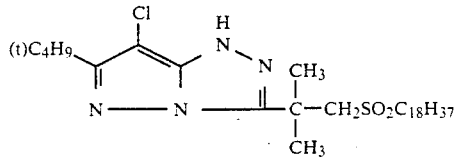

-continued
39
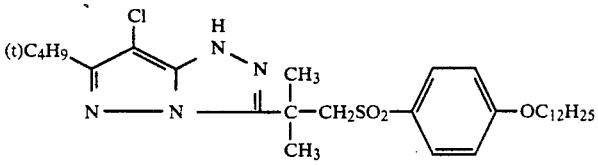
40
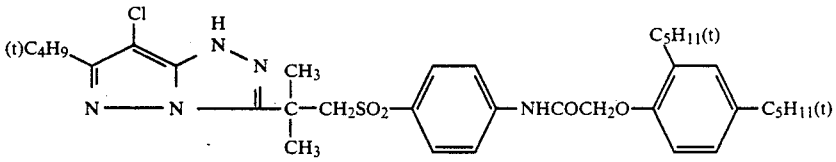
41
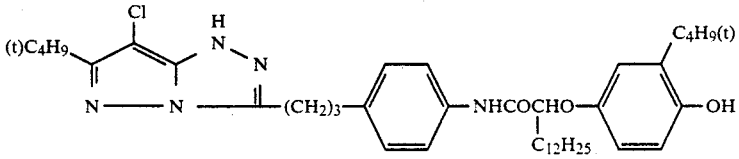
42
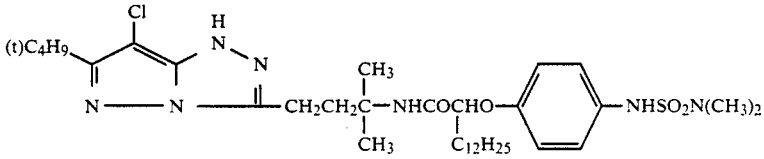
43
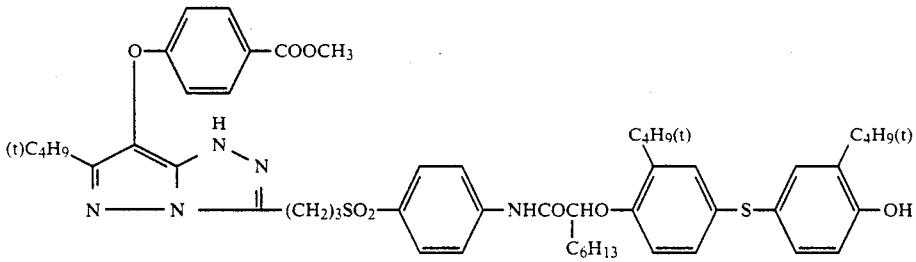
44
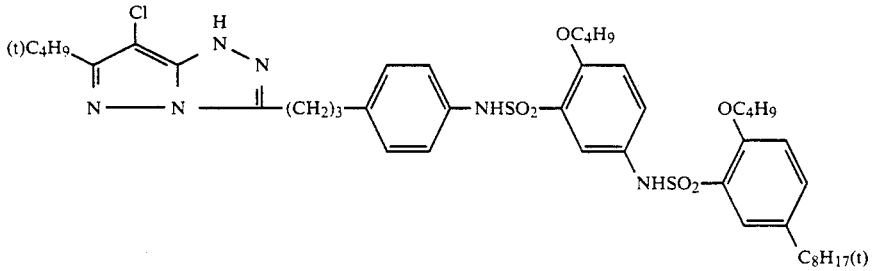
45
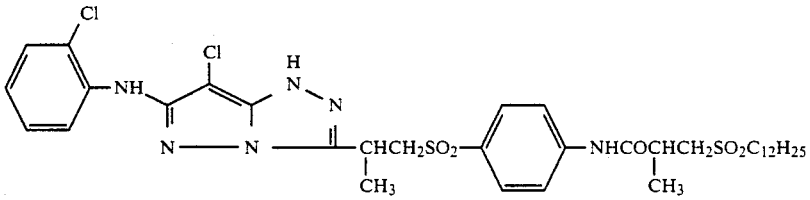
46
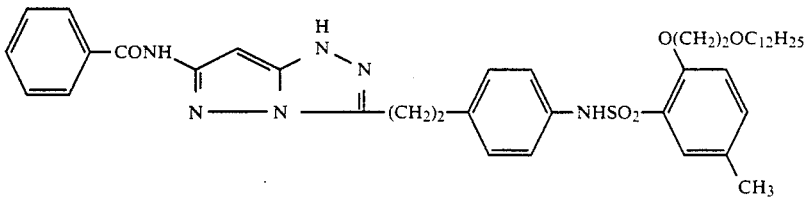

-continued
47
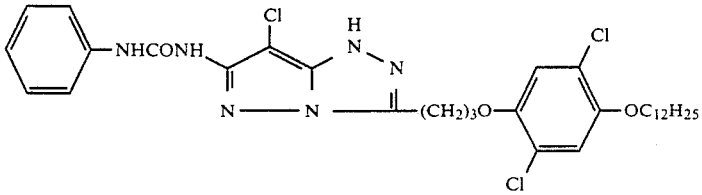
48
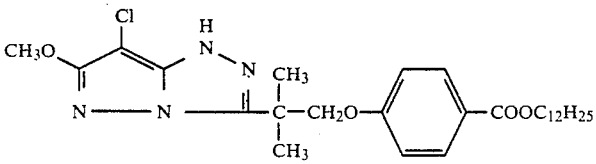
49
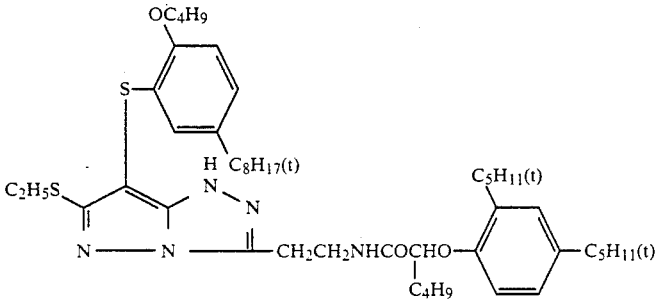
50
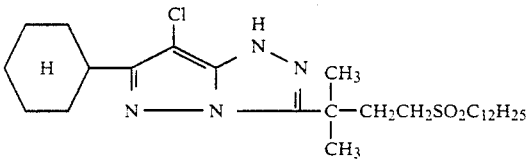
51
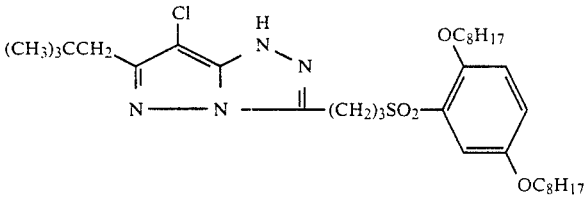
52
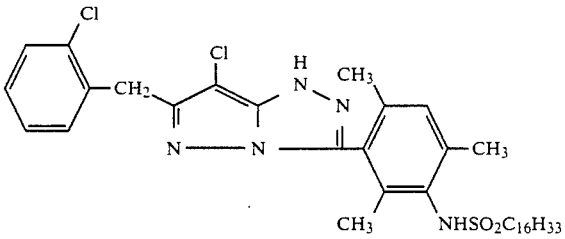
53
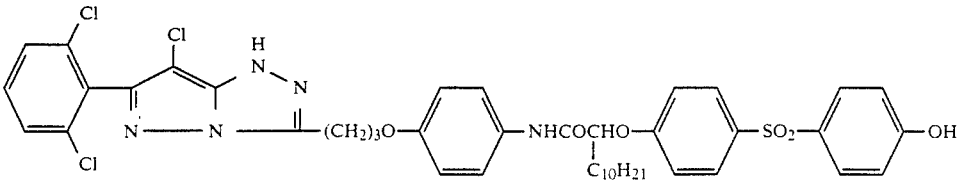

-continued
54
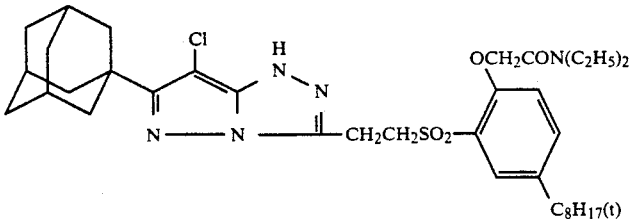
55
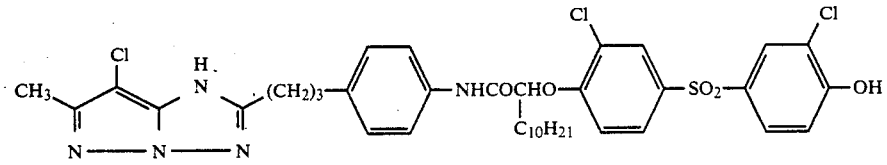
56
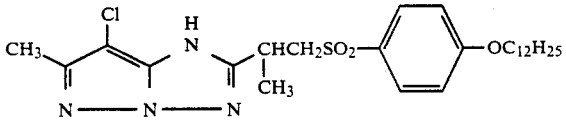
57
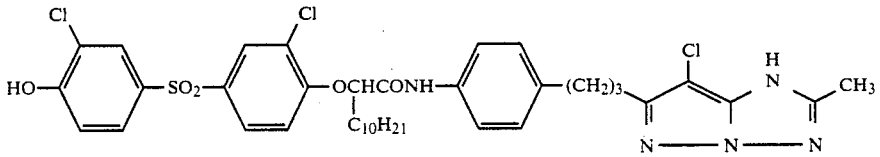
58
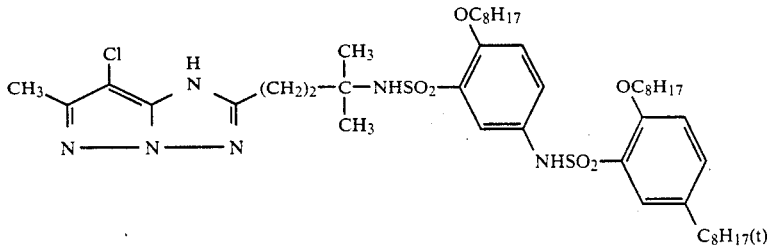
59
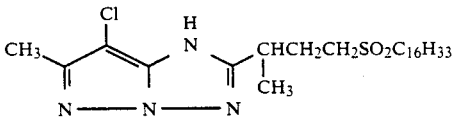
60
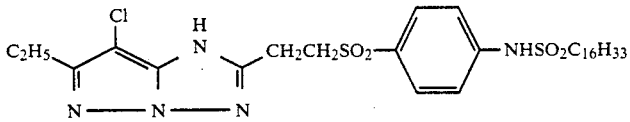
61
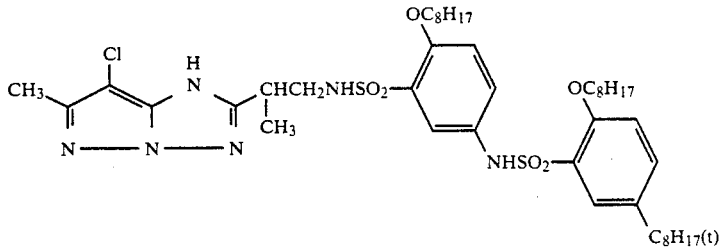
62
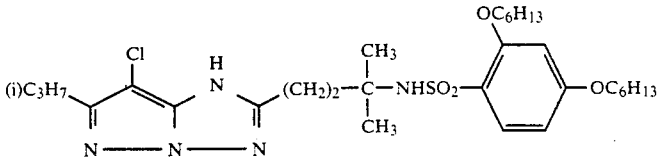

-continued
63
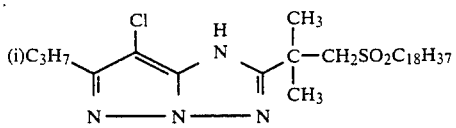
64
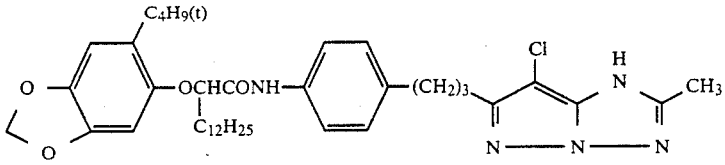
65
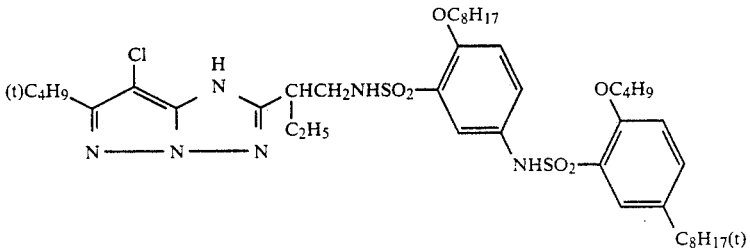
66
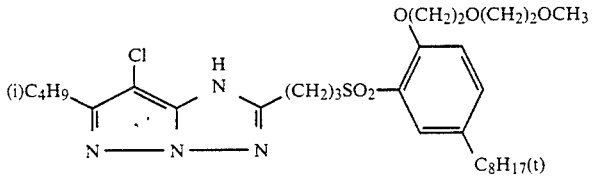
67
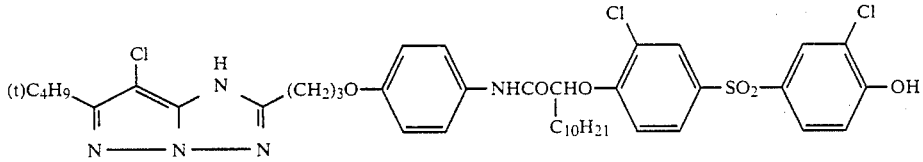
68
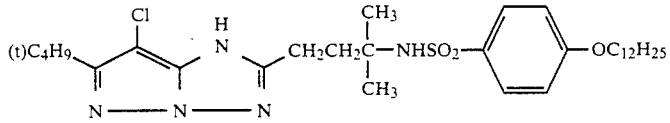
69
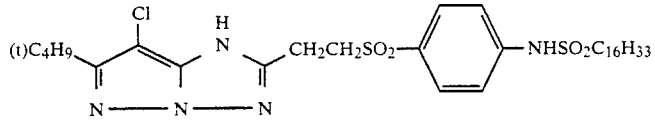
70
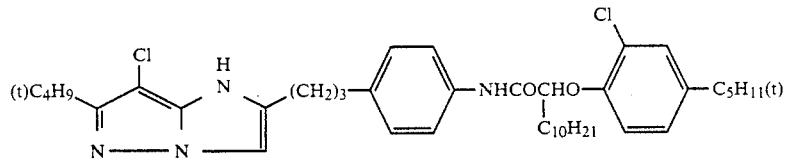
71
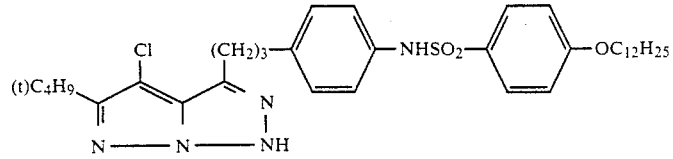

-continued
72
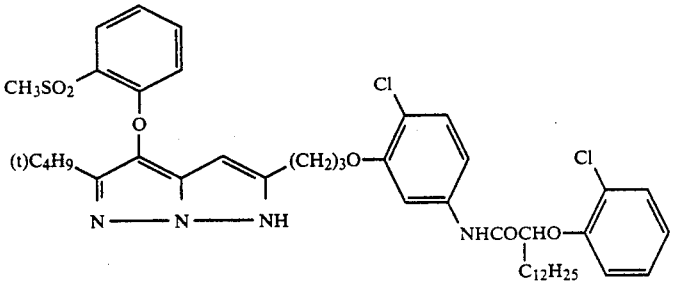
73
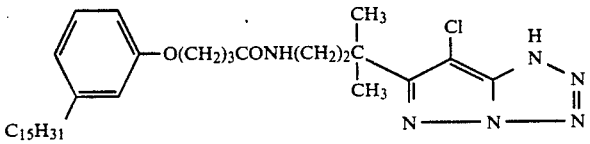
74
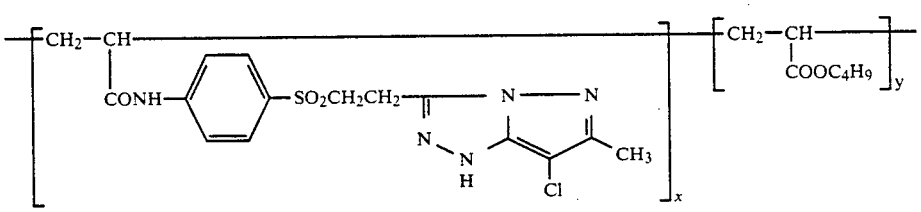
x:y = 50:50
75
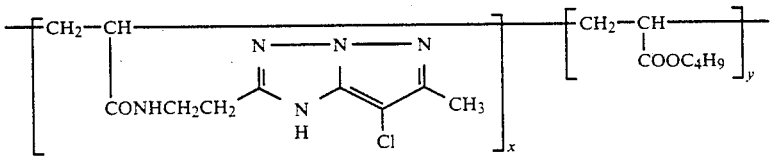
x:y = 50:50
76
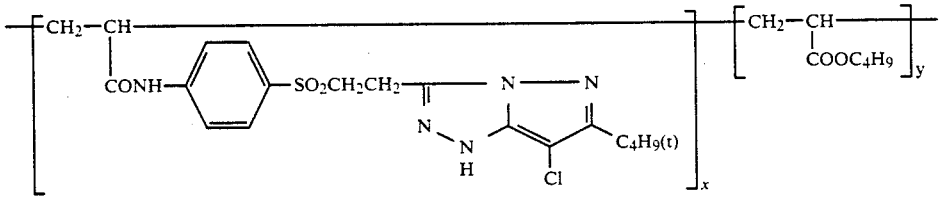
x:y = 50:50
77
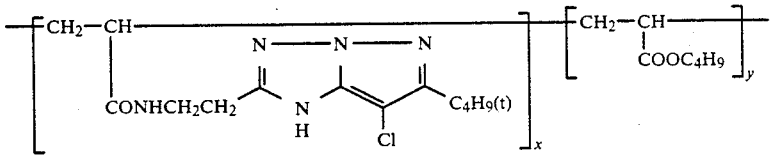
x:y = 50:50
Examples of usable cyan couplers are phenolic and naphthol series couplers. Either 4-equivalent type or 2-equivalent type can be used same as the case of yellow couplers. Actual examples of the cyan couplers examples are described in U.S. Pat. Nos. 2,369,929, 2,434,272, 2,474,293, 2,521,908, 2,895,826, 3,034,892, 3,311,476, 3,458,315, 3,476,563, 3,583,971, 3,159,383, 3,767,411, 3,772,002, 3,933,494 and 4,004,929, German Patent (OLS) Nos. 2,414,830 and 2,454,329, Japanese Patent O.P.I. Publication Nos. 5983(1973), 26034(1976), 5055(1973), 146827(1976), 69624(1977), 90932(1977), 95346(1983), and 11572(1974). Especially preferable examples of cyan coupler are ones represented by Formula (C-1) or (C-2) given in Japanese Patent O.P.I. Publication 106655(1988) (p.518 to 526) which are effective for prevention of stain after processing and fluctuation of properties of light-sensitive material due to change of processing conditions.

Colored magenta couplers, colored cyan couplers or polymer couplers can be used in combination with each other in the silver halide emulsion layer or other photographic component layers. With respect to the colored magent coupler and the cyan colored coupler, Japanese Patent O.P.I. Publication No. 72235(1986) can be referred. Japanese Patent O.P.I. Publication applied by the same applicants No. 50143(1986) can be referred relating to the polymer coupler.

Although adding amount of these couplers are not limited, preferable amount is $1\times10^{-3}$ to 5 mol, more preferably $1\times10^{-2}$ to $5\times10^{-1}$ mol per mol of silver.

Various kinds of additives for photographic materials are usable to the silver halide color light-sensitive materials of this invention such as fog inhibitor stabilizers, ultraviolet absorbents, color-stain inhibitors, fluorescent whitening agents, color-image fading inhibitors, antistatic agents, hardening agents, surface active agents, plasticisers and humidifiers, which are shown in Research Disclosure Magazine No. 17643.

As the support of the light-sensitive materials of this invention, reflecting supporters such as polyethylen-coated paper and baryta paper and transparent supporters can be used. These supporters can be selected freely for the purpose of photographic materials.

In the photographic materials applying this invention, an intermediate layer of a proper thickness can be provided in response to the purpose. Various layers can also be arranged such as filter layer, unti-curling layer, protective layer and antihalation layer, all of them can be used with combination properly. A hydrophilic colloid usable to emulsion layers can be used as the binder of these layers. Various photographic additives applicable to photographic emulsions can be contained in these layers.

Use of a nitrogen-containing heterocyclic mercapto compound in combination with the high silver chloride light-sensitive material of this invention is very effective to increase the performance of this invention and also nicely available for the protection of the stain caused by bleach-fixing solution.

The nitrogen ring used in the above-mentioned nitrogen-containing heterocyclic mercapto compounds are preferably selected from the group of rings of imidaline, imidazole, imidazolone, pyrozoline, oxazoline, oxazole, oxazolone, thiazoline, thiazole, thiazolone, selenazoline, selenazole, selenazolone, oxadiazole, thiadiazole, triazole, tetrazole, benzimidazole, benzotriazole, indazole, benzoxazole, benzothiazole, benzoselenazole, pyrazine, pyrimidine, pyridazine, triazine, oxazine, thiazine tetrazine, quinazoline, phthalazine and polyazaindenes, e.g. triazaindene, tetrazaindene and petazaindene. Particularly preferable compounds among them are those having the rings such as oxazole, oxadiazole, thiadiazole, triazole, tetrazole, benzimidazole, benzotriazole, pyrimidine, triazine and polyazaindenes.

Actual examples of usable nitrogen-containing heterocyclic mercapto compounds are shown in the following:

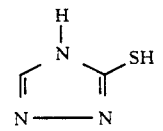

I-1

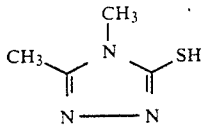

I-2

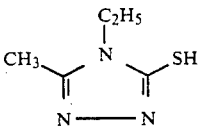

I-3

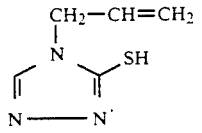

I-4

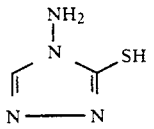

I-5

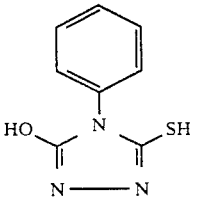

I-6

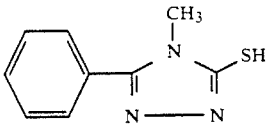

I-7

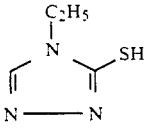

I-8

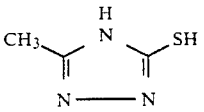

I-9

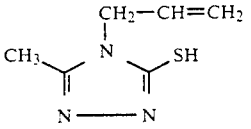

I-10

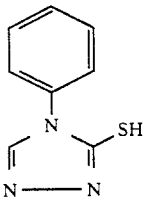

I-11

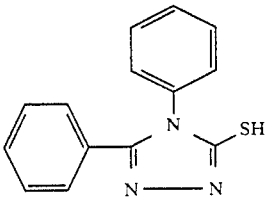

I-12

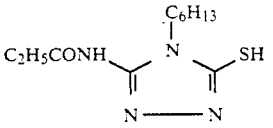

I-13

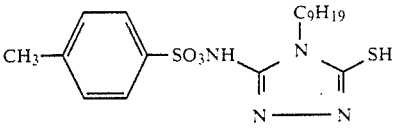

I-14

-continued
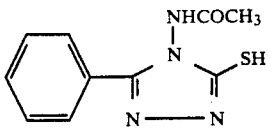
I-15
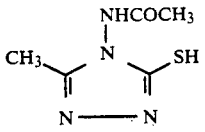
I-16
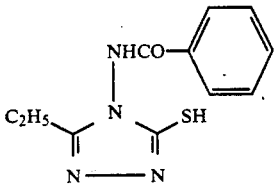
I-17
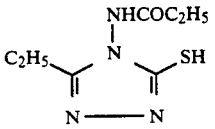
I-18
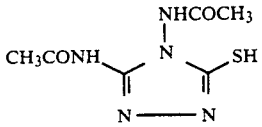
I-19
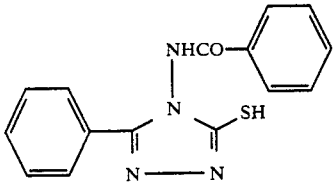
I-20
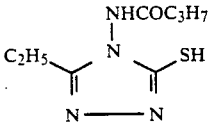
I-21
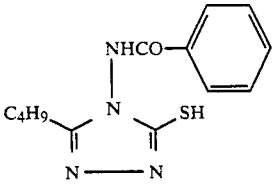
I-22
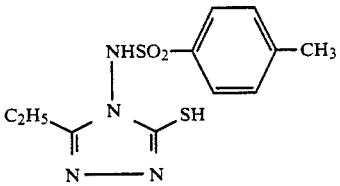
I-23
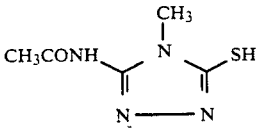
I-24
-continued
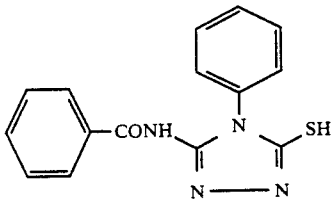
I-25
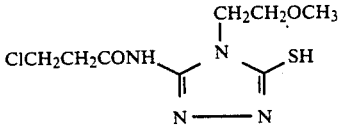
I-26
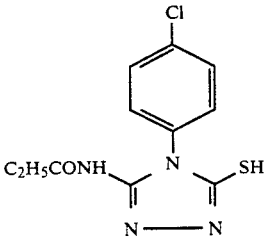
I-27
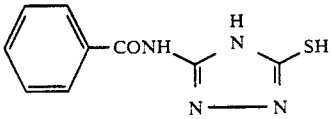
I-28
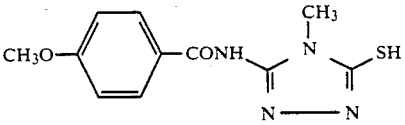
I-29
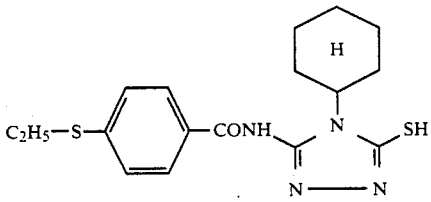
I-30
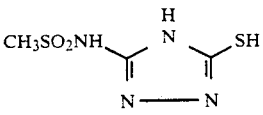
I-31
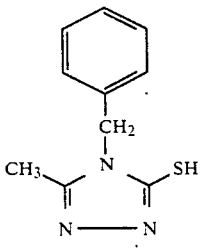
I-32

-continued
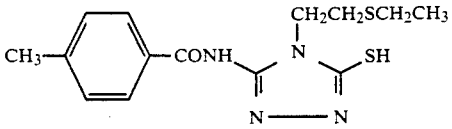
I-33
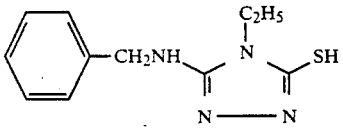
I-34
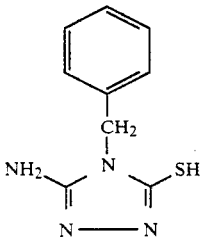
I-35
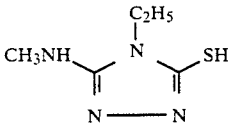
I-36
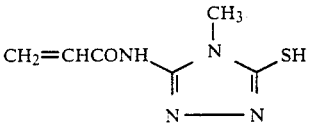
I-37
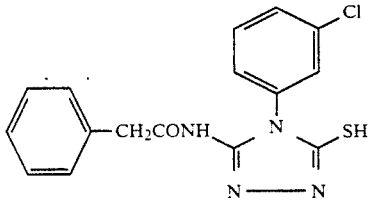
I-38
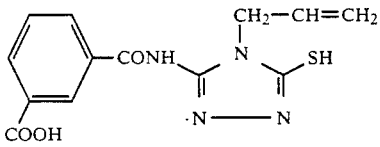
I-39
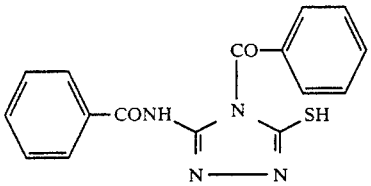
I-40
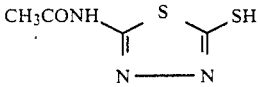
I-41
-continued
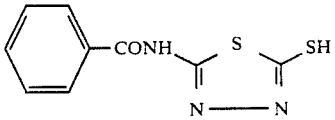
I-42
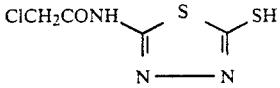
I-43
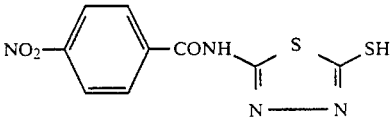
I-44
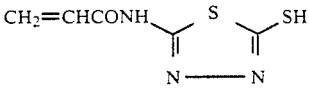
I-45
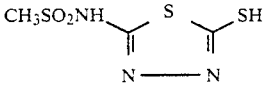
I-46
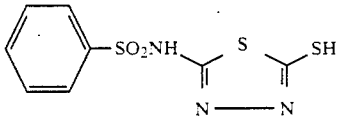
I-47
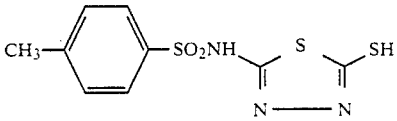
I-48
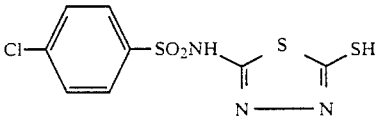
I-49
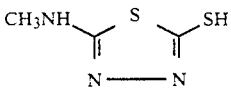
I-50
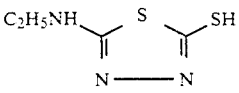
I-51
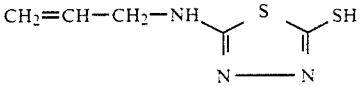
I-52

-continued
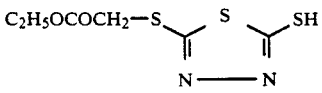
I-53
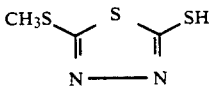
I-54
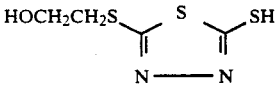
I-55
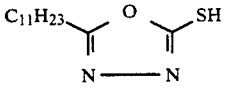
I-56
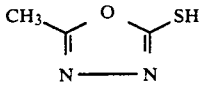
I-57
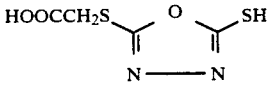
I-58
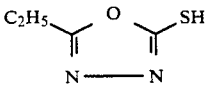
I-59
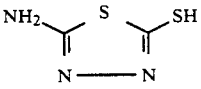
I-60
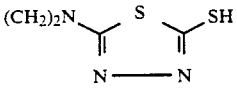
I-61
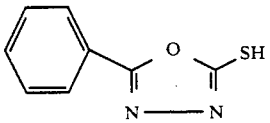
I-62
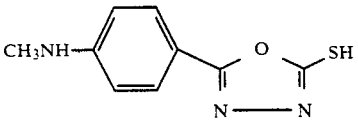
I-63
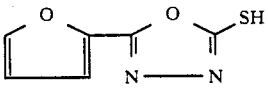
I-64
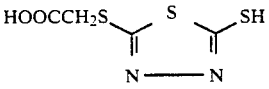
I-65
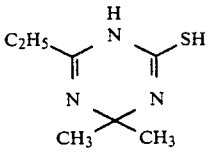
I-66
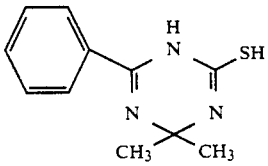
I-67
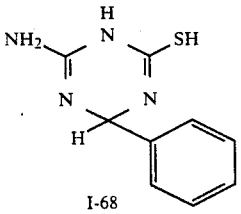
I-68
-continued
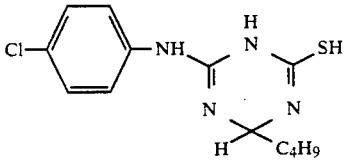
I-69
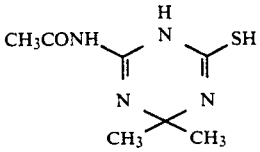
I-70
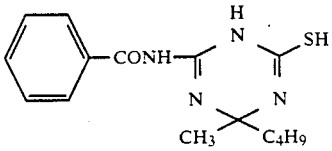
I-71
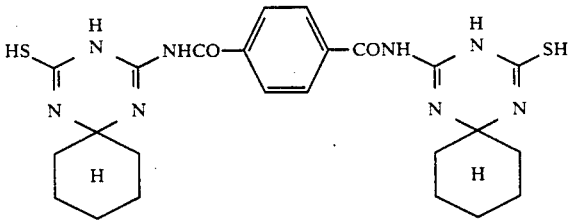
I-72
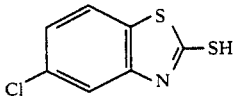
I-73
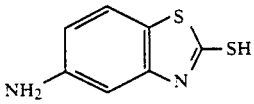
I-74
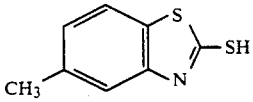
I-75
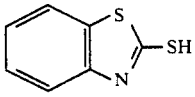
I-76
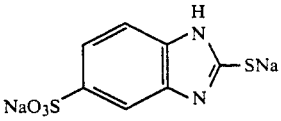
I-77
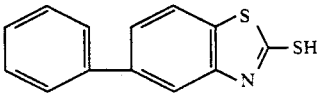
I-78

-continued

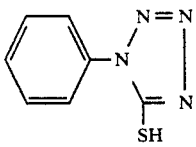

I-79

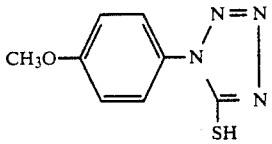

I-80

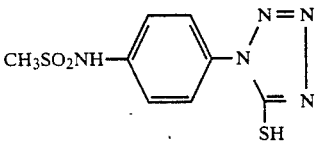

I-81

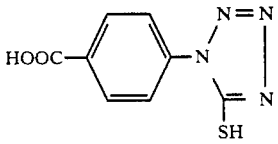

I-82

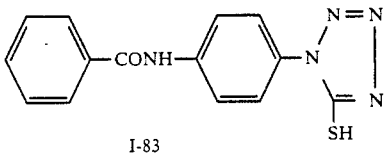

I-83

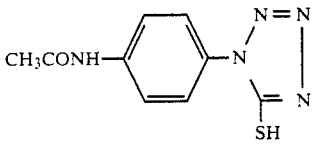

I-84

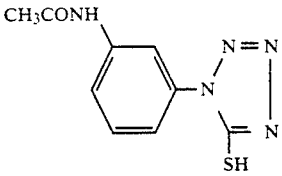

I-85

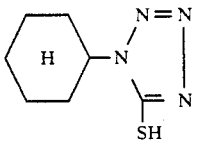

I-86

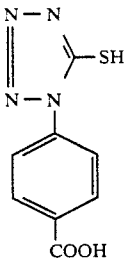

I-87

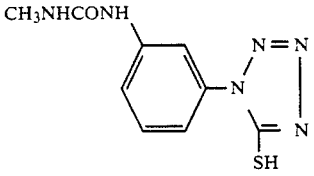

I-88

These compounds can be synthesized by referring J. Chem. Soc. 49, 1948, 1927; J. Org. Chem. 39, 2469, 1965; Japanese Patent O.P.I. Publications 89034(1975), 79436(1980), 102639 and No. 59463(1980); Annalen Chem. 44-3, 1954; Japan Patent Examined Publication 28496(1965); Chem. Berichte 20, 231, 1887; U.S. Pat. No. 3,259,976; Chem. Pharmaceutical Bulletin (Tokyo) 26, 314(1978); Berichte Deutschen Chem. Gesellschaft 82, 121(1948); U.S. Pat. Nos. 2,843,491, and 3,017,270; Brit. Patent 940,169; Journal of American Chemical Society 44, 1502 to 1510.

In this invention, these mercapto compounds should preferably be applied to more than two photographic layers.

The amount of these mercapto compounds to be added is widely changeable according to the constitution of the layer of silver halide photographic light-sensitive materials, kind of used mercapto compound, amount of silver halide and method of processing. Preferable amount is usually $10^{-8}$ $10^{-4}$ mol per $m^2$ of the light-sensitive material, and more preferably, $10^{-7}$ to $10^{-5}$ mol/$m^2$. These values are changeable according not to its total amount but to the extent of fogging of each emulsion layer and the effectiveness of added mercapto compound in each layer.

Components of photosensitive materials can be made to contain by conventional methods described in, for example, U.S. Pat. Nos. 2,322,027, 2,533,514, 3,689,271, 3,764,336 and No. 3,765,897. Couplers and UV absorbent can be made to contain as the type of charged latex described in German Patent (OSL) 2,541,274 and European Patent Application 14,921.

Components can be fixed in the light-sensitive material as in form of polymer described in, for example German Patent (OSL) 2,044,992, U.S. Pat. Nos. 3,370,952 and 4,080,211.

Swelling degree of the photographic layer of the photosensitive materials of this invention should be to 1.5 to 3.5; preferably, 2.0 to 3.2. Swelling degree is defined by the ratio between the thickness of the photographic layer after dipping in distilled water for 2 minutes and the thickness of the layer at dry state.

When the swelling degree exceeds 3.5, the fog of unexposed part becomes too high, when it is smaller than 1.5 the proper maximum density cannot be obtained. In case of high swelling degree, higher than 3.5 good results can not be obtained because the density of yellow stain becomes too high. Furthermore, the mechanical strength of the photographic layer is degraded resulting in an increase of trouble caused by scratches. The load for drying is also increased because of the increase in the amount of absorbed water.

In the above sentence the "photographic layer" means a groups of multi-coated hydrophilic colloid layers which includes at least one silver halide light-sensitive emulsion layer, and the layers included the photographic layer are water permiable with each other. The backing layer provided on the side of the support opposite to the photographic layer is not included in the photographic layer in definition. The photographic layer is usually composed of two or more layers some of which are for forming a photographic image. In the photographic layer, layers such as filter layer, halation-preventive layer and protect layer can be included in addition to the silver halide emulsion layer.

To control the swelling degree within the above-mentioned range, various methods can be taken such as the control of the amount and the kind of gelatin and hardener and the drying and ageing conditions after coating of the photographic layer. Gelatin is advantageously used for photographic layer but various other hydrophic materials can also be used such as gelatin derivatives, graft polymers of gelatin and other high-molecular substances, proteins such as albumine and casein; cellulose derivatives such as hydroxyethyl cellulose, carboxymethyl cellulose and sulfuric acid ester of cellulose; saccaride derivatives such as sodium arginate and starch derivatives; various kinds of synthetic hydrophilic high-molecular substances, namely, homo- or copolymers such as polyvinylalcohol, partially acetalized polyvinyl alcohol, poly-N-vinyl pyrolidone, polyacrylic acid, polymetacrylic acid, polyacryl amide, polyvinyl imidazole, polyvinyl pyrazole.

Various kinds of gelatin can be used as well as ordinary lime-treated gelatin. Acid-treated gelatin, hydrolized gelatin, enzyme decomposition product of gelatin and gelatin derivatives obtained by treating with various chemicals such as acid halides, acid anhydrides, isocyanates, bromoacetic acid, alkanesultones, vinyl sulfonamides, maleimides, polyalkylene oxides, epoxy compounds, etc. Actual examples are shown in U.S. Pat. Nos. 2,614,928, 3,132,945, 3,186,846 and 3.312.553, British Patent Nos. 861,414, 1,033,189 and 1,005,784, Japanese Patent Examined Publication No. 26845(1967).

As examples of above-mentioned gelatin graft polymers, the follows can be cited: gelatin graft-polymerized with homo- or co-polymers of vinyl series compounds such as acrylic acid, metacrylic acid and their derivatives such as esters and imides these of, and homo- or co-polymer of vinyl series monomer such as acrylonitril and styrene. Especially, polymers which have some miscribility to gelatin such as graft polymers with the polymers of acrylic acid, metacrylic acid, acrylic amide, metacrylic amide hydroxyalkyl metacrylate are preferable. Actual examples of typical synthetic hydrophilic high-polymers are shown in German Patent (OLS) No. 2,312,708, U.S. Pat. Nos. 3,620,751 and 3,879,205, Japanese Patent Examined Publication No. 7561(1968).

As examples of applicable hardeners, the following can be cited: Chromium salts such as chromium alum, chromium acetate; aldehydes such as formaldehyde, glyoxal, glutaraldehyde; N-methylol compounds such as dimethylol urea, methylol dimethyl hydantoin; dioxane derivatives such as 2,3-dihydroxy dioxane; active vinyl compounds such as 3,5-triacryloyl-hexahydro-s-triazine, bis (vinyl sulfonyl) methylether, N,N'-methylene bis-[β-(vinylsulfonyl) propionamide; active halogen compounds such as 2,4-dichloro-6-hydroxy-s-triazine; muco-halogenic acids such as mucochloric acid, mucophenoxychloric acid; isoxazoles, dialdehyde starch, 2-chloro-6-hydroxytriazinyl gelatin, etc. Their actual examples are described in U.S. Pat. Nos. 1870354, 2080019, 2726162, 2870013, 2983611, 2992109, 3047394, 3057723, 3103437, 3321313, 3325287, 3362827, 3539644 and 3543292; British Patent Nos. 676628, 825544 and 1270578; German Patent Nos. 872153 and 1090427, Japanese Patent Examined Publications Nos. 7133(1959) and 1872(1971).

Especially preferable hardeners are aldehydes, active vinyl compounds and active halogen compounds.

Conventional supports are applicable to the silver halide color light-sensitive materials of this invention, for example, the support made of cellulose esters such as the cellulose acetate and the support made of polyesters. Support made of paper is also proper for use which can be laminated with polyethylene or polypropylene. Regarding the above-mentioned, Research Disclosure No. 17643, section X VI can be referred.

Ordinary hydrophilic film-forming materials can be used for the protective colloid or the binder of the layer of the light-sensitive material. As examples, proteins such as gelatin, arginic acid and their esters or other derivatives (amides and salts, for example), cellulose derivatives such as carboxymethyl cellulose and cellulose sulfate, starch and its derivatives, synthetic hydrophilic binders. Regarding the binders, the above-mentioned Research Disclosure No. 17643 section IX is also referable.

The light-sensitive material layer which is provided on the support can be hardened with conventional hardening method using ordinary hardeners such as epoxide, heterocyclic ethylene imine or acryloyl type hardener. It is also possible to apply the method written in German Patent (OSL) 218,009 to harden strengthen the color photosensitive layer applicable to high temperature treatment. The above-mentioned layer can also be hardened with diazine, triazine or 1,2-dihydroquinoline type hardener or vinyl sulfone type hardener. Other proper hardeners are disclosed in German Patents 2,439,551, 2,225,230 and 2,317,672 and also in above-mentioned Research Disclosure No. 17643, section XI.

EXAMPLES

Actual embodiments of this invention are described hereinafter. The scope of this invention is not limited to these.

EXAMPLE 1

Experiments were carried out by using the under-mentioned color papers, processing solutions and processing procedure.

A color photographic material was prepared by coating the below-mentioned photographic layers on a support of polyethylene-coated paper.

Polyethylene paper: a mixture of 200 weight parts of polyethylene, mean molecular weight 100,000, density 0.95, and 20 weight parts of polyethylene, mean molecular weight 2000, density 0.80 was prepared and added with 7.5 wt % of anatase-type titanium oxide and coated on a surface of high quality paper, weight of 170 g/m$^2$, with a thickness of 0.035 mm with extruding coating method. The back side of the paper was coated with a layer consisted of polyethylene with a thickness 0.04 mm.

The front side of the paper was pretreated with corona discharge and then the following layers are coated on it successively.

First layer

This layer was a blue-sensitive silver halide emulsion layer comprised of a silver halide emulsion having the silver a halide composition shown in Table 1. The emulsion contained 350 g of gelatin per mol of silver halide and was sensitized by the below-mentioned sensitizing dye (SB-1) of $2.6\times10^{-4}$ mol per mol of silver halide solved in isopropyl alcohol. The emulsion layer also contained 200 mg/m$^2$ of 2,5-di-t-butyl hydroquinone and $2.1\times10^{-1}$ mol/mol of silver halide of the below-mentioned yellow coupler Y which were dissolved in dibutyl phthalate and dispersed in the layer. The layer was coated so that the coating amount was 250 mg silver/m$^2$.

SB-1

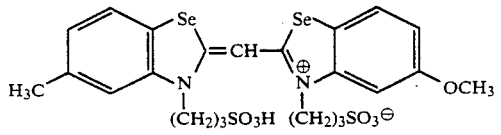

Second layer

This was a gelatin layer containing 290 mg/m$^2$ of di-t-octyl hydroquinone and 190 mg/m$^2$ of a mixture of 2-(2'-hydroxy-3',5'-di-t-butyl-phenyl) benzotriazole, 2-(2'-hydroxy-3'-t-butyl-5'-methylphenyl)-5-chlorobenzotriazole and 2-(2-hydroxy-3',5'-di-t-butyl-phenyl)5-chloro-benzotriazole as UV absorbents. Coating amount of gelatin was 1900 mg/m$^2$.

Third layer

This layer is a green-sensitive silver halide emulsion layer comprised of a silver halide emulsion having a silver halide composition described in Table 1. The emulsion contained 400 g per mol of silver of gelatin and was sensitized with the sensitizing dye SG-1 shown below.

SG-1

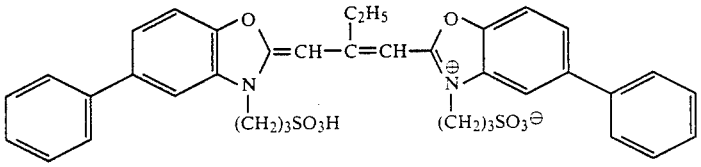

The amount of the dye was $2.6\times10^{-4}$ mg/per mol of silver halide. The emulsion layer also contained magenta coupler M-1 which was dissolved in a mixture of dibutyl phthalate and tricresyl phophate (2:1) and dispersed in the emulsion in the amount of $1.7\times10^{-1}$ mol mole of silver halide. This emulsion was coated so as the silver amount of 250 mg/m$^2$. An oxidation inhibitor, 2,2,4-trimethyl-6-lauryloxy-7-t-octyl cumarone, was contained with the amount of 0.3 mole/mole of the coupler.

Fourth layer

This layer was a gelatin layer containing 35 mg/m$^2$ of di-t-octyl hydroquinone and a mixture of UV absorbents (2:1.5:1.5:2) of 2-(2'-hydroxy-3',5'-di-t-butyl phenyl) benzotriazole, 2-(2'-hydroxy-5'-t-butylphenyl) benzotriazole, 2-(2'-hydroxy-3'-t-butyl-5'-methyl-phenyl)-5'-chlorobenzotriazole and 2-(2'-hydroxy-3',5'-t-butyl phenyl)-5-chlorobenzo-triazole which were disolved in dioctyl phthalate and dispersed in the layer. The amount of coated gelatin was 1900 mg/m$^2$.

Fifth layer

This was a red-sensitive silver halide emulsion layer comprised of silver halide emulsion having a silver halide composition shown in Table 1. The emulsion contained 460 g per mol of silver halide of gelatin and was sensitized with $2.2\times10^{-5}$ mol per mol of silver halide of a sensitizing dye SR-1 having the structure shown below. The emulsion layer also contained 150 mg/m$^2$ of 2,5-di-t-butyl hydroquinone and two kinds of cyan couplers, C-1 and C-2 in the ratio of 1:1, in the amount of $3.2\times10^{-1}$ mol per mol of silver halide which were dissolved in dibutyl phthalate and dispersed in the layer. The layer was coated in so as the amount of silver to be 305 mg/m$^2$.

SR-1

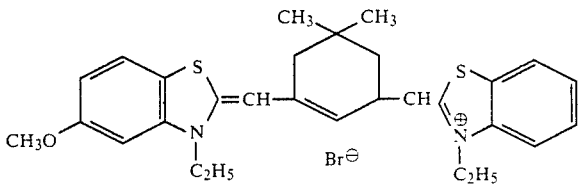

Sixth layer

This layer was a gelatin layer which was coated so as the amount of gelatin to be 900 mg/m$^2$.

The silver halide emulsion used in each photosensitive emulsion layer, first, third and fifth layers was prepared with the method described in Japanese Patent Examined Publication 7772 (1971) and chemically sensitized with sodium thiosulfate 5-hydrate, and added with a stabilizer of 4-hydroxy-6-methyl-1,3,3*a*,7-tetrazaindene, a hardener of bis(vinylsulfonyl methyl ether, and a coating aids of saponine.

Yellow coupler Y-1

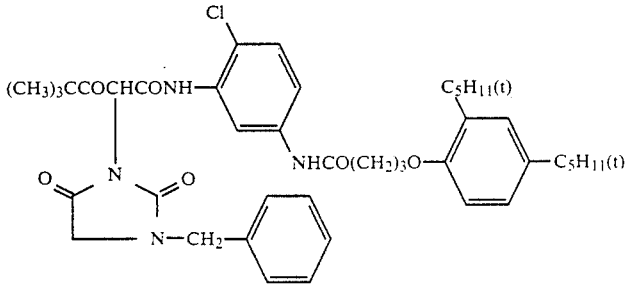

-continued

Yellow coupler Y-2

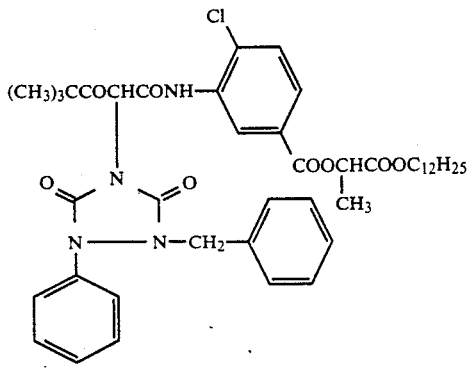

Magenta coupler M-1

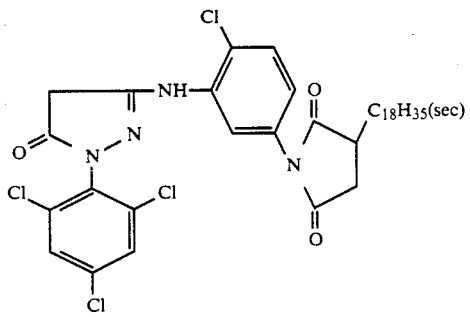

Cyan coupler C-1

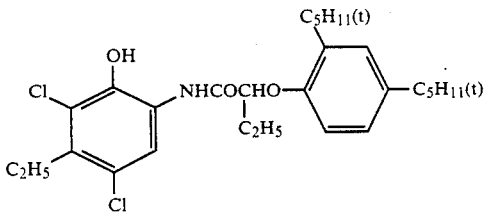

Cyan coupler C-2

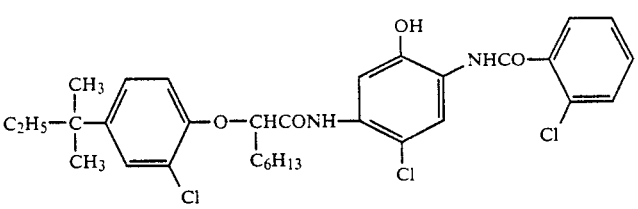

By changing the addition amount of hardener and the condition of drying after coating the swelling degree of photographic layer was controlled as shown in below-mentione Table 1.

Each of the above-mentioned photosensitive materials of which the composition of silver halide and the swelling degree were changed, was stepwise exposed to light and processed with the below-mentioned processes and solutions. The maximum density of the yellow in samples was measured. At the same time the density of magenta dye in unexposed area was measured. Results are shown below Table 1.

Treatment Process

| | | |
|---|---|---|
| (1) Color developing | 32.8° C. | 3 min 30 sec |
| (2) Bleaching and fixing | 35° C. | 1 min 30 sec |
| (3) Washing with water | 25-35° C. | 3 min |
| (4) Drying | 60-90° C. | About 2 min |

Composition of Treating Solution

Color Developing Solution (Tank Solution)

| | |
|---|---|
| Ethylene glycol | 15 ml |
| Potassium sulfite | 1.0 g |
| Sodium chloride | 1.5 g |
| Potassium carbonate | 30 g |
| 3-methyl-4-amino-N-(β-methane-sulfonamido ethyl)-aniline sulphate | 5.2 g |
| Fluorescent whitening agent (diaminostilbene type) | 1.0 g |
| Hydroxylamine derivative (Table 1) | 3.5 g |
| Ethylenediaminetetraacetic acid | 3.0 g |
| Benzyl alcohol | 1.0 g |
| Potassium bromide | 0.4 g |

Add water make to 1 l and adjust the pH to 10.10.

Bleaching and fixing solution (tank solution)

| | |
|---|---|
| Ferric ammonium dihydrage | 60 g |
| Ethylenediaminetetraacetic acid | 3 g |
| Ammonium thiosulfate (70% solution) | 100 ml |

-continued

| | |
|---|---|
| Ammonium bisulfite (40% solution) | 27.5 ml |

Adjust pH to 6.0 with potassium carbonate or glacial acetic acid and make up to 1 l with water.

The color developing solution was used after adding ppm of ferric ion, as ferric ammonium ethylenediamine-tetraacetate , and 1 ppm of copper, as copper sulfate, and stored at a room temperature for one week in a bottle with an opening surface to air in the ratio of 20 $cm^2/l$ namely, 1 l solution was kept under the condition that the solution was exposed to air with the opening surface in the ratio of 20 $cm^2/l$.

TABLE 1

| Experiment No. | Composition of silver halide AgCl (mol %) | AgBr (mol %) | Swelling degree | Hydroxylamine derivative (3.5 g/l) | Yellow density at the maximum density area | Magenta density at unexposed density area | For reference |
|---|---|---|---|---|---|---|---|
| 1-1 | 20 | 80 | 2.4 | Exemplified compound (A-1) | 1.11 | 0.02 | Comparative |
| 1-2 | 50 | 50 | 2.4 | Exemplified compound (A-1) | 1.50 | 0.02 | Comparative |
| 1-3 | 80 | 20 | 2.4 | Exemplified compound (A-1) | 1.73 | 0.02 | Comparative |
| 1-4 | 90 | 10 | 2.4 | Exemplified compound (A-1) | 2.08 | 0.02 | Inventive |
| 1-5 | 95 | 5 | 2.4 | Exemplified compound (A-1) | 2.21 | 0.03 | Inventive |
| 1-6 | 98 | 2 | 2.4 | Exemplified compound (A-1) | 2.28 | 0.03 | Inventive |
| 1-7 | 99 | 1 | 2.4 | Exemplified compound (A-1) | 2.32 | 0.03 | Inventive |
| 1-8 | 99.5 | 0.5 | 2.4 | Exemplified compound (A-1) | 2.37 | 0.03 | Inventive |
| 1-9 | 100 | 0 | 2.4 | Exemplified compound (A-1) | 2.38 | 0.05 | Inventive |
| 1-10 | 99.5 | 0.5 | 1.0 | Exemplified compound (A-1) | 1.60 | 0.02 | Comparative |
| 1-11 | 99.5 | 0.5 | 1.2 | Exemplified compound (A-1) | 1.83 | 0.02 | Comparative |
| 1-12 | 99.5 | 0.5 | 1.5 | Exemplified compound (A-1) | 2.12 | 0.02 | Inventive |
| 1-13 | 99.5 | 0.5 | 1.8 | Exemplified compound (A-1) | 2.21 | 0.02 | Inventive |
| 1-14 | 99.5 | 0.5 | 2.0 | Exemplified compound (A-1) | 2.36 | 0.03 | Inventive |
| 1-15 | 99.5 | 0.5 | 2.4 | Exemplified compound (A-1) | 2.37 | 0.03 | Inventive |
| 1-16 | 99.5 | 0.5 | 2.8 | Exemplified compound (A-1) | 2.37 | 0.03 | Inventive |
| 1-17 | 99.5 | 0.5 | 3.2 | Exemplified compound (A-1) | 2.38 | 0.03 | Inventive |
| 1-18 | 99.5 | 0.5 | 3.5 | Exemplified compound (A-1) | 2.39 | 0.05 | Inventive |
| 1-19 | 99.5 | 0.5 | 4.0 | Exemplified compound (A-1) | 2.41 | 0.08 | Comparative |
| 1-20 | 99.5 | 0.5 | 4.5 | Exemplified compound (A-1) | 2.41 | 0.11 | Comparative |
| 1-21 | 99.5 | 0.5 | 5.0 | Exemplified compound (A-1) | 1.43 | 0.15 | Comparative |
| 1-22 | 99.5 | 0.5 | 2.4 | Not added | 1.39 | 0.13 | Comparative |
| 1-23 | 99.5 | 0.5 | 2.4 | Hydroxylamine sulfate | 1.88 | 0.12 | Comparative |
| 1-24 | 99.5 | 0.5 | 2.4 | Exemplified compound (A-2) | 2.36 | 0.03 | Inventive |
| 1-25 | 99.5 | 0.5 | 2.4 | Exemplified compound (A-4) | 2.35 | 0.03 | Inventive |
| 1-26 | 99.5 | 0.5 | 2.4 | Exemplified compound (A-10) | 2.36 | 0.04 | Inventive |
| 1-27 | 99.5 | 0.5 | 2.4 | Exemplified compound (A-13) | 2.35 | 0.03 | Inventive |
| 1-28 | 99.5 | 0.5 | 2.4 | Exemplified compound (A-16) | 2.36 | 0.03 | Inventive |
| 1-29 | 99.5 | 0.5 | 2.4 | Exemplified compound (A-18) | 2.40 | 0.03 | Inventive |
| 1-30 | 99.5 | 0.5 | 2.4 | Exemplified compound (A-21) | 2.39 | 0.02 | Inventive |
| 1-31 | 99.5 | 0.5 | 2.4 | Exemplified compound (A-25) | 2.36 | 0.03 | Inventive |

As shown in Table 1, when the composition of silver halide, swelling degree of photographic layer and the containment of specific hydroxylamine derivatives in the color developer were in the scope of this invention, a successful yellow dye density and a desirable lowered magenta fogging in unexposed area were obtained even if a heavy metal is coexisted.

EXAMPLE 2

Experiment similar to Example 1 was carried out by using the same color paper as that used in Experiment Nos. 1 to 8, except that the magenta coupler M-1 was replaced by the forementioned pyrazolo-triazole type magenta couplers 1, 2, 4, 21, 37, 61 or 63. The result was that the maximum density of yellow color was about the same as those in Experiment Nos. 1 to 8 and the magenta dye density in unexposed area was 0.02 both of which mean very favorable results.

EXAMPLE 3

Experiments to Example 1 was carried out by using the same color developers as that used in Experiment Nos. 1 to 8 except that the exemplified alkanol amine derivative compound D-2, D-3 or D-13 represented by the Formula D was added with the amount of 5 g/l. The maximum density of yellow color was made an increase about 0.20 and the density of magenta dye in unexposed area decreased by 0.01 to 0.02. The formation of tarry and crystalline substances in developer tank was improved.

EXAMPLE 4

Experiments similar to Example 1 were carried out by using the same color paper samples as used in Experiment Nos. 1 to 8 except that adding the exemplified marcapto compounds I-24, I-41, I-60, I-66, I-79 and I-84 were added compounds with the amount of 0.12 $mg/m^2$ each. The maximum densities of yellow color showed no change at all and the magenta fogging densities in unexposed areas lowered from 0.03 to 0.01.

EXAMPLE 5

Experiments similar Experiment Nos. 1 to 8 of Example 1 were carried out except that the time of color developing was changed as shown in Table 2. Result is shown in Table 2. The table indicates that the good results of this invention is obtained when the developing time is longer than 90 seconds.

TABLE 2

| Experiment No. | Treating time of color developing process (second) | Yellow density in the maximum density area | Magenta density in unexposed area |
|---|---|---|---|
| 2-1 | 45 | 2.01 | 0.01 |
| 2-2 | 70 | 2.06 | 0.02 |
| 2-3 | 90 | 2.18 | 0.02 |
| 2-4 | 100 | 2.20 | 0.03 |
| 2-5 | 120 | 2.28 | 0.03 |
| 2-6 | 150 | 2.35 | 0.03 |
| 2-7 | 210 | 2.37 | 0.03 |
| 2-8 | 240 | 2.38 | 0.03 |
| 2-9 | 300 | 2.40 | 0.04 |
| 2-10 | 360 | 2.43 | 0.05 |

EXAMPLE 6

A light-sensitive material, color paper, was prepared by using polyethylene-coated paper which was same as used in Example 1 and by coating the six layers whose components are described below.

First layer

The layer is a blue-sensitive silver halide emulsion layer comprised of silver chloromide emulsion having the silver chloride content of 99.0 mol %. The emulsion contained 350 g gelatin per mol of silver halide and was sensitized with a sensitizing dye SB-1 in the amount of $2.5\times10^{-4}$ mol per mol of silver halide, the dye was dissolved in isopropyl alcohol. The layer also contained 200 mg/m$^2$ of 2,5-di-t-butyl hydroquinone and $2\times10^{-1}$ mol/1 mol of silver halide of yellow coupler Y-1 which were dissolved in dibutyl phthalate and dispersed in the layer. This layer was coated so as the silver amount of 300 mg/m$^2$.

Second layer

This is a gelatin layer containing 300 mg/m$^2$ of di-t-octyl hydroquinone and 200 mg/m$^2$ of a mixture of UV absorbents of 2-(2'-hydroxy-3', 5'-di-t-butyl phenyl) benzotriazole, 2-(2'-hydroxy-5'-t-butyl phenyl) benzotriazole, 2-(2'-hydroxy-3't-butyl-5'-methyl phenyl)-5-chlorobenzotriazole and 2-(2-hydroxy-3', 5'-di-t-butyl phenyl)-5-chloro-benzotriazole, which were dissolved in dibutyl phethalate and dispersed in the layer. The gelatin layer was coated on the support with the amount 1900 mg/m$^2$.

Third layer

This layer was green-sensitive silver halide emulsion layer comprised of a silver chlorobromide emulsion. The emulsion contained 450 g of gelatin and was sensitized with the sensitizing dye SG-1. The amount of the dye used was $2.5\times10^{-4}$ mg per mol of silver halide. Magenta coupler M-1 was dissolving in a mixture of dibutyl phthalate and tricresyl phophate (2:1) and dispersed in the layer with the amount of $1.5\times10^{-1}$ mol per mole of silver halide. This emulsion was coated so as the amount of silver of 280 mg/m$^2$. Oxidation inhibitor, 2,2,4-trimethyl-6-lauryloxy-7-t-octyl cumarone, was contained in the amount of 0.3 mole per mole of the coupler.

Fourth layer

This layer contained a dispersion of dictyl phthalate in which 30 mg/m$^2$ of di-t-octyl hydroquinone phthalate and 500 mg/m$^2$ of UV absorbent a mixture of 2-(2'-hydroxy-3', 5'-di-t-butyl phenyl) benzotriazole, 2-(2'-hydroxy-5'-t-butylphenyl) benzotriazole, 2-(2'-hydroxy-3'-t-butyl-5'-methylphenyl)-5'-chlorobenzotriazole and 2-(2'-hydroxy-3', 5'-t-butylphenyl)-5-chlorobenzotriazole, in the ratio of 2:1.5:1.5:2, were dissolved. The layer was coated so that the amount of gelatin was 1900 mg/m$^2$.

Fifth layer

This is a red-sensitive silver chlorobromide emulsion layer comprised of a silver halide emulsion having the silver chloride content of 99%. The emulsion contained 500 g per mol silver halide of gelatin and was sensitized with a sensitizing dye in the amount of $2.5\times10^{-5}$ mol per mol of silver halide. It also contained 150 mg/m$^2$ of 2,5-di-t-butyl hydroquinone and $3.5\times10^{-1}$ mol per mole of silver halide of cyan coupler (C-1) which was dissolved in dibutyl phthalate and dispersed in the layer. The layer was coated so as the amount of 280 mg silver/m$^2$.

Sixth layer

This layer was a gelatin layer coated so the gelatin was amount 900 mg/m$^2$.

The silver halide emulsion used in each light-sensitive emulsion layer, the first, third and fifth layer was prepared with the method described in Japanese Patent Examined Publication 7772 (1971) and chemically sensitized with sodium thiosulfate 5-hydrate, and added with a stabilizer, 4-hydroxy-6-methyl-1,3,3*a*,7-tetrazaindene and, a hardener, bis vinylsulfonyl methyl ether, and a coating additive, saponine.

The swelling degree of the photographic layer of the samples was 2.5.

The above-mentioned light-sensitive material was each picture-printed and then continuously processed with an automatic processing machine by using below-mentioned processing solutions.

Treatment Process

| | | |
|---|---|---|
| (1) Color developing | 33° C. | 3 min 30 sec |
| (2) Bleaching and fixing | 35° C. | 1 min |
| (3) Washing with water | 30-35° C. | 2 min |
| (4) Drying | 60-85° C. | About 2 min |

Composition of Treating Solution

Color Developing Solution (Tank Developing)

| | |
|---|---|
| Potassium bromide | 0.6 g |
| Potassium chloride | 2.5 g |
| Potassium sulfite (50% solution) | 1.0 ml |
| 3-Methyl-4-amino-N-(β-methane-sulfonamido ethyl)-aniline sulfate | 5.2 g |
| Hydroxylamine derivative (Table 3) | 5.0 g |
| Triethanol amine | 10.0 g |
| Potassium carbonate | 30 g |
| Sodium diethylenetriaminepentaacetate | 5.0 g |

Make to one liter with water and adjust pH to 10.15 by using potassium hydroxide or sulfuric acid.

Color Developer Replenisher

| | |
|---|---|
| Potassium bromide | 0.7 g |
| Potassium chloride | 2.5 g |
| Potassium sulfite (50% solution) | 1.0 ml |
| 3-Methyl-4-amino-N-(β-methane-sulfonamido ethyl)-aniline sulphate | 7.5 g |
| Preservative agent (see Table 3) | 7.0 g |

-continued

| | |
|---|---|
| Triethanol amine | 10.0 g |
| Potassium carbonate | 30 g |
| Diethylenetriaminepentaacetic acid | 5.0 g |

Make to one liter with water and adjust the pH to 10.40 using potassium hydroxide or sulfuric acid Bleach-Fixer (Tank Solution)

| | |
|---|---|
| Ferric ammonium ethylenediaminetetraaceate dihydrate | 60 g |
| Ethylenediaminetetraacetic acid | 3.0 g |
| Ammonium thiosulfate (70% solution) | 100.0 ml |
| Ammonium sulfite (40% solution) | 20 m |

The pH was adjusted to 5.50 by using aqueous ammonia or glacial acetic acid and the total amount was made to one liter by adding water.

Bleach-Fixer Replenisher

| | |
|---|---|
| Ferric ammonium ethylenediaminetetraacetate dihydrate | 70.0 g |
| Ethylendiaminetetraacetic acid | 3.0 g |
| Ammonium thiosulfate (70% solution) | 120 ml |
| Ammonium sulfite (40% solution) | 20 ml |

pH of the solution was adjusted to 5.50 by using aqueous ammonia and glacial acetic acid and the total amount was made to one liter by adding water Stabilizer for Replacing Water Washing (Tank Solution)

| | |
|---|---|
| Sodium dichloroisocyanurate | 0.1 g |
| 5-Chloro-2-methyl-4-isothiazoline-3-on | 0.02 g |
| 2-Methyl-4-isothiazolin-3-on | 0.02 g |
| Benzotriazole | 0.1 g |
| Ethyleneglycol | 1.0 g |

-continued

| | |
|---|---|
| 2-Octyl-4-isothiazoline-3-on | 0.01 g |
| 1-Hydroxyethylidene-1,1-diphophonic acid (60% queous solution) | 3.0 g |
| $BiCl_3$ (45% aqueous solution) | 0.65 g |
| $MgSO_47H_2O$ | 0.2 g |
| Aqueous ammonia (25% aqueous solution of $NH_4OH$) | 2.5 g |
| Trisodium nitrotriacetate | 1.5 g |

pH of the mixture was adjusted to 7.0 by using aqueous ammonia and sulfuric acid and the total amount was made to one liter by adding water.

The processing was run by filling the above-mentioned color developer tank solution, bleach-fixer tank solution and stabilizing tank solution in the automatic developing machine and the above-mentioned color paper was treated there. During the treatment, the above-mentioned colordeveler replenisher, bleach-fixer replenisher and stabilizer replenisher were added by three minute interval with a quantitative pump.

Replenishing amount to the color developer tank was 160 ml per $m^2$ of the processed color paper, the amount of bleach-fixer replenisher to supply to bleach-fixer tank per $m^2$ was as shown in Table 1. The replenishing amount of stabilizer replenisher was 250 ml per $m^2$ of the processed color paper.

Three tanks were used as the stabilizing baths of the automatic machine which are called No. 1 to No. 3 in the order of the current direction. Replenishing was carried out from the last tank and the overflow of the last tank was poured to the second tank whose overflow was then poured to the first one, so-called multistage counter-current system.

At the time when the amount of bleach-fixer replenisher supplied to the bleach-fixing bath attained 3 times of the volume of the tank, a check sample which had been wedge-exposed was passed through the machine and the minimum density of it was measured with PDA-65 (a product of Konica & Co.). Result is shown in Table 3.

TABLE 3

| | Sample No. | Preservant (g/l) | Replenishing amount for bleach-fixer ($ml/m^2$) | Minimum reflection density | | |
|---|---|---|---|---|---|---|
| | | | | Blue density | Green density | Red density |
| Comparative | 6-1 | Hydroxylamine sulfate | 300 | 0.08 | 0.07 | 0.07 |
| Comparative | 6-2 | Hydroxylamine sulfate | 200 | 0.10 | 0.08 | 0.09 |
| Comparative | 6-3 | Hydroxylamine sulfate | 100 | 0.12 | 0.10 | 0.12 |
| Comparative | 6-4 | Hydroxylamine | 50 | 0.15 | 0.14 | 0.13 |
| Comparative | 6-5 | Exemplified compound A-1 | 300 | 0.06 | 0.05 | 0.05 |
| Inventive | 6-6 | Exemplified compound A-1 | 200 | 0.06 | 0.05 | 0.05 |
| Inventive | 6-7 | Exemplified compound A-1 | 100 | 0.07 | 0.05 | 0.05 |
| Inventive | 6-8 | Exemplified | 50 | 0.08 | 0.06 | 0.06 |
| Comparative | 6-9 | Exemplified compound A-18 | 300 | 0.06 | 0.05 | 0.05 |
| Inventive | 6-10 | Exemplified compound A-18 | 200 | 0.06 | 0.05 | 0.05 |
| Inventive | 6-11 | Exemplified compound A-18 | 100 | 0.07 | 0.05 | 0.05 |
| Inventive | 6-12 | Exemplified compound A-18 | 50 | 0.08 | 0.06 | 0.06 |
| Comparative | 6-13 | Exemplified compound A-21 | 300 | 0.06 | 0.05 | 0.05 |
| Inventive | 6-14 | Exemplified compound A-21 | 200 | 0.06 | 0.05 | 0.05 |
| Inventive | 6-15 | Exemplified | 100 | 0.06 | 0.05 | 0.05 |

TABLE 3-continued

| | Sample No. | Preservant (g/l) | Replenishing amount for bleach-fixer (ml/m²) | Minimum reflection density Blue density | Green density | Red density |
|---|---|---|---|---|---|---|
| Inventive | 6-16 | compound A-21 Exemplified compound A-21 | 50 | 0.07 | 0.06 | 0.06 |
| Comparative | 6-17 | D-glucosamine hydrochloride | 300 | 0.09 | 0.07 | 0.07 |
| Comparative | 6-18 | D-glucosamine hydrochloride | 200 | 0.11 | 0.09 | 0.09 |
| Comparative | 6-19 | D-glucosamine hydrochloride | 100 | 0.13 | 0.11 | 0.13 |
| Comparative | 6-20 | D-glucosamine | 50 | 0.16 | 0.14 | 0.15 |
| Comparative | 6-21 | Glucose | 300 | 0.10 | 0.08 | 0.08 |
| Comparative | 6-22 | Glucose | 200 | 0.12 | 0.09 | 0.10 |
| Comparative | 6-23 | Glucose | 100 | 0.15 | 0.12 | 0.13 |
| Comparative | 6-24 | Glucose | 50 | 0.17 | 0.16 | 0.16 |

As shown in Table 3, when the color developing process was carried out by using the preserver of this invention and the replenishing amount of the bleach-fixer solution was in the scope of this invention, formation of the stain was effectively inhibited. Such stain-inhibiting effect could not be obtained by the use of other reserveres such as hydroxylamine sulfate, D-glucosamine hydrochloride or glucose.

EXAMPLE 7

The color developer after running of the processing which had been used in Example 6 and the bleach-fixers 6-1 to 6-24, were stored in a bottle whose at 50° C., in which the solutions were exposed to the air with 150 cm² of open surface per liter of the solution. The number of days required for forming tarry, and those for forming the precipitation of sulfur or silver sulfide were observed with respect to the developer and the bleach-fixer, respectively. The results are given in Table 4.

TABLE 4

| Sample No. | Number of days for forming tarry substance in the color developer | Number of days for forming sulfur or silver sulfide in the bleach-fixer |
|---|---|---|
| 6-1 | 9 | 19 |
| 6-2 | 9 | 14 |
| 6-3 | 9 | 10 |
| 6-4 | 9 | 7 |
| 6-5 | 28 | 24 |
| 6-6 | 27 | 24 |
| 6-7 | 27 | 23 |
| 6-8 | 27 | 21 |
| 6-9 | 30 | 26 |
| 6-10 | 30 | 26 |
| 6-11 | 30 | 24 |
| 6-12 | 30 | 22 |
| 6-13 | 35 | 29 |
| 6-14 | 35 | 29 |
| 6-15 | 35 | 27 |
| 6-16 | 35 | 25 |
| 6-17 | 8 | 17 |
| 6-18 | 8 | 11 |
| 6-19 | 8 | 7 |
| 6-20 | 8 | 6 |
| 6-21 | 2 | 10 |
| 6-22 | 2 | 7 |
| 6-23 | 2 | 5 |
| 6-24 | 2 | 3 |

As shown in Table 4, the tarry substance was easily formed when the preservants other than that of this invention were used. The sulfur or silver sulfide was easily formed when the preservants other than that of this invention was used. These results proves the preservativities of color developer and bleach-fixer were improved by the use of the preserver of this invention. Moreover, when the amount of replenisher of bleach and fixing solution was decreased the effect of this invention was much enhanced.

EXAMPLE 8

Experiments were carried out in the manner similar to that of Example 6 except that the composition of the silver halide color light-sensitive material was made as shown in Table 5 and the preserver of color developer was changed to the exemplified hydroxylamine compound A-1 shown represented by Formula (I). The amount of residual silver was measured. Result is shown in Table 5.

TABLE 5

| Sample No. | Composition of silver halide Br/Cl (mol ratio) | Replenishing amount for bleach-fixer (ml/m²) | Amount of residual silver (mg/100 cm²) |
|---|---|---|---|
| 8-1 | 80/20 | 300 | 0.10 |
| 8-2 | | 200 | 0.17 |
| 8-3 | | 100 | 0.28 |
| 8-4 | | 50 | 0.39 |
| 8-5 | 20/80 | 300 | 0.05 |
| 8-6 | | 200 | 0.09 |
| 8-7 | | 100 | 0.13 |
| 8-8 | | 50 | 0.23 |
| 8-9 | 10/90 | 300 | 0.02 |
| 8-10 | | 200 | 0.02 |
| 8-11 | | 100 | 0.03 |
| 8-12 | | 50 | 0.04 |
| 8-13 | 0.5/99.5 | 300 | 0.02 |
| 8-14 | | 200 | 0.02 |
| 8-15 | | 100 | 0.02 |
| 8-16 | | 50 | 0.03 |

As shown in this table, the amount of residual silver was decreased when the ratio of silver chloride is increased; especially the silver chloride content is more than 90%. It is indicates that the silver halide color light-sensitive material having a high silver chloride content is excellent in desilverization property and it is a favorable light-sensitive material to reduce the replenishing amount of the bleach-fixer.

EXAMPLE 9

Experiments were carried out in the manner similar to that of Example 6 using the light-sensitive materials mentioned in Example 6 except that 1.5 ml/l of benzyl alcohol was added into each of the color developing tank solution and its replenisher, and the exemplified hydroxylamine compound A-1 or A-18 represented by Formula (I) or hydroxylamine sulfate was used as the preserver of the color developer. The amount of replenishing of the bleach-fixer was 80 ml/l. Test results are shown in Table 6.

TABLE 6

| Sample No. | Preserver (g/l) | Bleach-fixing time (second) | Minimum reflecting density Blue density | Green density | Red density |
|---|---|---|---|---|---|
| 9-1 | Hydroxylamine sulfate | 25 | 0.10 | 0.09 | 0.09 |
| 9-2 | | 45 | 0.12 | 0.11 | 0.11 |
| 9-3 | | 60 | 0.14 | 0.12 | 0.13 |
| 9-4 | | 90 | 0.16 | 0.13 | 0.14 |
| 9-5 | | 180 | 0.19 | 0.15 | 0.16 |
| 9-6 | Exemplified | 25 | 0.07 | 0.05 | 0.05 |
| 9-7 | compound A-1 | 45 | 0.07 | 0.05 | 0.05 |
| 9-8 | | 60 | 0.07 | 0.05 | 0.05 |
| 9-9 | | 90 | 0.07 | 0.05 | 0.05 |
| 9-10 | | 180 | 0.08 | 0.06 | 0.06 |
| 9-11 | Exemplified | 25 | 0.07 | 0.05 | 0.05 |
| 9-12 | compound A-18 | 45 | 0.07 | 0.05 | 0.05 |
| 9-13 | | 60 | 0.07 | 0.05 | 0.05 |
| 9-14 | | 90 | 0.08 | 0.06 | 0.06 |

TABLE 6-continued

| Sample No. | Preserver (g/l) | Bleach-fixing time (second) | Minimum reflecting density Blue density | Green density | Red density |
|---|---|---|---|---|---|
| 9-15 | | 180 | 0.09 | 0.07 | 0.07 |

As indicated in the marvelous result of this table, the occurring of stain was suppressed by the use of hydroxylamine derivative of this invention even if the bleach-fixing time was elongated. The remarkable result is clearly shown in this table.

EXAMPLE 10

Experiments similar to Example 9 were carried out by using light-sensitive materials the same as those of Example 6 except that the magenta coupler was replaced by forementioned magenta coupler 1, 2, 4, 21, 37, 62, or 63 and cyan coupler was replaced by each cyan coupler of (C'-1) to (C'-10) and (C''-1) to (C''-3). The stain was improved to 0.01–0.03 in magenta and 0.02–0.04 in cyan. This effect was remarkably observed in case when the duration of bleach-fixing was elongated.

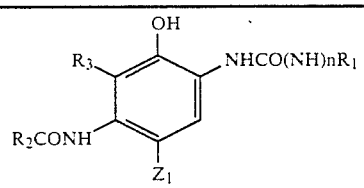

| Comp. No. | $R_1$ | $R_2$ | $R_3$ | $Z_1$ | n |
|---|---|---|---|---|---|
| C'-1 | 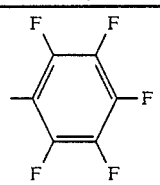 | 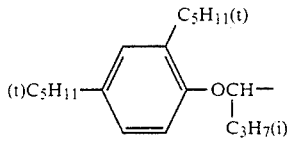 | —H | —Cl | 0 |
| C'-2 | 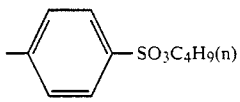 | 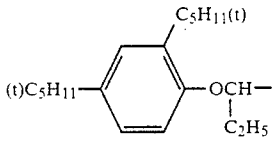 | —H | —H | 1 |
| C'-3 | 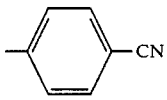 | 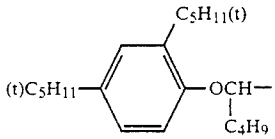 | —H | 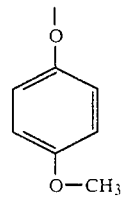 | 1 |
| C'-4 | —$C_3F_7$(n) | 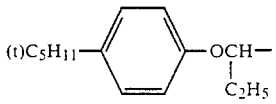 | —H | —H | 0 |
| C'-5 | 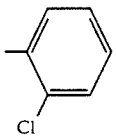 | 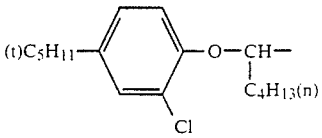 | —H | —Cl | 0 |

-continued

| | | | | | |
|---|---|---|---|---|---|
| C'-6 | 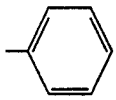 | 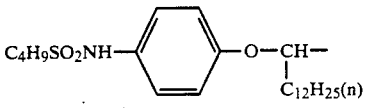 | —H | —Cl | 0 |
| C'-7 | 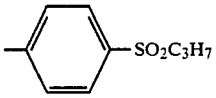 | 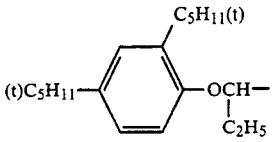 | —H | —H | 1 |
| C'-8 | 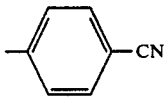 | 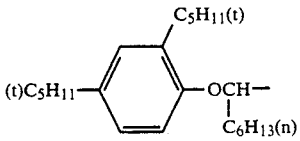 | —H | 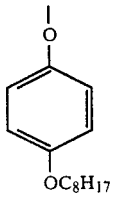 | 1 |
| C'-9 | 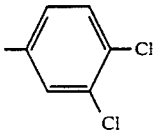 | 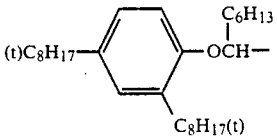 | —H | —H | 1 |

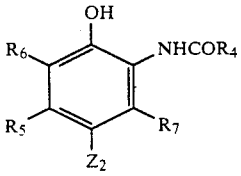

| Comp. No. | $R_5$ | $Z_2$ | $R_4$ | $R_7$ | $R_6$ |
|---|---|---|---|---|---|
| C''-1 | $-C_2H_5$ | —Cl | 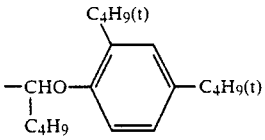 | —H | —Cl |
| C''-2 | $-C_2H_5$ | —Cl | 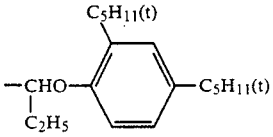 | —H | —Cl |
| C''-3 | $-C_2H_5$ | —Cl | 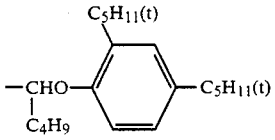 | —H | —Cl |

EXAMPLE 11

Experiments the same as Example 9 were carried out by using light-sensitive materials similar to that of the same as those of Example 6 except that in each of with 0.12 mg/m$^2$ of the mercapto compounds (0.12 mg/m$^2$) exemplified as I-24, I-41, I-60, I-66, I-79 and I-84 were added, respectively and using the photosensitive material. The stain was improved similar to the results of Example 10 as that the yellow, magenta and cyan stain was suppressed as the lowering of stain density of 0.01 to 0.03, respectively. This effect was remarkably observed in case when the duration of bleach-fixing was elongated similar to the result of Example 10.

EXAMPLE 12

The Experiments were carried out by using the below-mentioned color papers and processing solutions.

On the support made of polyethylene-coated paper the same as described in Example 1, the below-mentioned layers were coated successively from the support side and a light-sensitive material was obtained.

First layer

This layer is a blue-sensitive silver halide emulsion layer comprised of a emulsion having a silver halide composition shown in Table 7. The emulsion contains 340 g gelatin per mol of silver halide and is sensitized by $2.5\times10^{-4}$ mol per of silver halide of sensitizing dye (SB-1) which was dissolved in isopropyl alcohol. The layer also contained 200 mg/m$^2$ of 2,5-di-t-butyl hydroquinone and the below-mentioned yellow coupler Y of $2\times10^{-1}$ mol/mol of silver halide, which were dissolved in dibutyl phthalate and dispersed in the layer. Coating amount was 290 mg silver/m$^2$.

Second layer

This was a gelatin layer containing 300 mg/m$^2$ of di-t-octyl hydroquinone and 200 mg/m$^2$ of a mixture of 2-(2'-hydroxy-3', 5'-di-t-butyl-phenyl) benzotriazole, 2-(2'-hydroxy-3'-t-butyl-5'-methyl-phenyl)-5-chlorobenzotriazole and 2-(2-hydroxy-3', 5'-di-t-butyl-phenyl)-5-chloro-benzotriazole which were dissolved in dibutyl phthalate and dispersed in the layer. Coating amount of gelatin was 1800 mg/m$^2$.

Third layer

This layer was a green-sensitive silver halide emulsion layer comprised of an emulsion having a silver halide composition described in Table 7. The emulsion contained 420 g of gelatin and sensitized with $2.6\times10^{-4}$ mg per mol of silver halide of the sensitizing dyestuff SG-1.

The emulsion layer contained magenta coupler M-1 in the amount of $1.6\times10^{-1}$ mol per mole of silver halide which was dispersed after dissolving in a mixture of dibutyl phthalate and tricresyl phophate (2:1). This emulsion was coated so as the silver amount of 270 mg/m$^2$. Oxidation inhibitor—2,2,4-trimethyl-6-lauryloxy-7-t-octyl cumarone was also contained in the amount of 0.3 mol per mole of the coupler.

Fourth layer

This layer was a gelatin layer which contained 31 mg/m$^2$ of di-t-octyl hydroquinone and a mixture ultraviolet ray absorbents (2:1.5:1.5:2) of 2-(2'-hydroxy-3', 5'-di-t-butyl phenyl) benzotriazole, 2-(2'-hydroxy-5'-t-butylphenyl) benzotriazole, 2-(2'-hydroxy-3'-t-butyl-5'-methylphenyl)-5'-chlorobenzotriazo le and 2-(2'-hydroxy-3', 5'-t-butylphenyl)-5-chlorobenzotriazole which were dissolved in dioctyl phthalate and dispersed in the layer. The amount of the mixture contained in the gelatin layer was 490 mg/m$^2$. The amount of coated gelatin was 2000 mg/m$^2$.

Fifth layer

This was a red-sensitive silver halide emulsion layer comprised of an emulsion having a silver halide composition shown in Table 7. The emulsion contained 490 g per mol of gelatin and was sensitized with a sensitizing dyestuff in the amount of $2.4\times10^{-5}$ mol per mol of silver halide. layer also contained 150 mg/m$^2$ of 2,5-di-t-butyl hydroquinone and two kind of cyan couplers of C-1 and C-2, the ratio of two couplers was 1:1, in the amount of $3.5\times10^{-1}$ mol per mol of silver halide which were dissolved in dibutyl phthalate and dispersed in the layer. The layer was coated so as the silver of 290 mg/m$^2$.

Sixth layer

This layer was the gelatin layer in which gelatin was coated so as the gelatin of amount 1000 mg/m$^2$.

The silver halide emulsion used in each first, third and fifth light-sensitive emulsion layers was prepared with the method described in Japanese Patent Examined Publication 7772(1971), and chemically sensitized with sodium thiosulfate 5-hydrate and added with a (4-hydroxy-6-methyl-1,3,3*a*,7-tetrazaindene as a stabilizer, a hardener bis(vinylsulfonyl methyl) ether as a hardener, and a coating additive saponine as a coating aid.

The swelling degrees of the photographic layer of the samples were 2.5. The above-mentioned light-sensitive materials, in which the composition of silver halide and were stepwise exposed to light, and processed with the below-mentioned process and solutions. The maximum density of the yellow dye in samples was measured. At the same time the density of magenta in unexposed are a was measured. Results are shown in below Table 7.

(Processing procedure)

| | | |
|---|---|---|
| (1) Color developing | 34° C. | see Table 1 |
| (2) Bleach-fixing | 35° C. | 1 min 30 sec |
| (3) Washing with water | 25–35° C. | 1 min |
| (4) Drying | 75–100° C. | About 2 min |

Composition of Treating Solution

Color Developer (Tank Solution)

| | |
|---|---|
| Ethylene glycol | 15 ml |
| Potassium sulfite | 1.0 g |
| Sodium chloride | 1.5 g |
| Potassium carbonate | 30 g |
| 3-Methyl-4-amino-N-(β-methane-sulfonamido ethyl)-aniline sulfate | 5.2 g |
| Fluorescent bleaching agent (diaminostilbene type) | 1.0 g |
| Hydroxylamine sulfate | 1.5 g |
| Hydroxyethyliminodiacetic acid | 5.0 g |
| Benzyl alcohol (see Table 7) | |
| Potassium bromide (see Table 7) | |
| Disodium 1,2-dihydroxybenzene-3,5-disulfonate | 0.2 g |

Make to one liter with water and adjust pH to 10.20 with KOH and $H_2SO_4$.

Beach-Fixer (Tank Solution)

| | |
|---|---|
| Ferric ammonium ethylene diaminetetraacetate dihydrate | 60 g |
| Ethylenediaminetetraacetic acid | 3 g |
| Ammonium thiosulfate (70% solution) | 100 ml |
| Ammonium bisulfite (40% solution) | 27.5 ml |

Adjust pH to 7.1 with potassium carbonate or glacial acetic acid and make volume to one liter with water.

The color developer was used after adding 2 ppm of ferric ion as ethylenediaminetetraacetic acid ferric ammonium and 1 ppm of copper ion and stored at 35° C. for 5 days in a bottle with an opening ratio of 20 cm$^2$/liter namely one liter solution was kept in a bottle having the opening surface to air in the ratio 20 cm$^2$/liter.

TABLE 7

| Experiment No. | Composition of silver halide AgCl (mol %) | AgBr (mol %) | Color developer Added amount of KBr (mol/l) | Benzyl alcohol (g/1) | Color developing time (second) | Yellow density in the maximum density area | Magenta density in the unexposed area |
|---|---|---|---|---|---|---|---|
| 12-1 | 20 | 80 | $6 \times 10^{-3}$ | 1.5 | 210 | 1.28 | 0.02 |
| 12-2 | 50 | 50 | $6 \times 10^{-3}$ | 1.5 | 210 | 1.54 | 0.02 |
| 12-3 | 80 | 20 | $6 \times 10^{-3}$ | 1.5 | 210 | 1.76 | 0.02 |
| 12-4 | 90 | 10 | $6 \times 10^{-3}$ | 1.5 | 210 | 2.12 | 0.02 |
| 12-5 | 95 | 5 | $6 \times 10^{-3}$ | 1.6 | 210 | 2.32 | 0.02 |
| 12-6 | 98 | 2 | $6 \times 10^{-3}$ | 1.5 | 210 | 2.47 | 0.03 |
| 12-7 | 99 | 1 | $6 \times 10^{-3}$ | 1.5 | 210 | 2.49 | 0.03 |
| 12-8 | 99.5 | 0.5 | $6 \times 10^{-3}$ | 1.5 | 210 | 2.52 | 0.03 |
| 12-9 | 100 | 0 | $6 \times 10^{-3}$ | 1.5 | 210 | 2.53 | 0.04 |
| 12-10 | 99.5 | 0.5 | 0 | 1.5 | 210 | 2.61 | 0.12 |
| 12-11 | 99.5 | 0.5 | $2 \times 10^{-4}$ | 1.5 | 210 | 2.56 | 0.08 |
| 12-12 | 99.5 | 0.5 | $4 \times 10^{-4}$ | 1.5 | 210 | 2.54 | 0.04 |
| 12-13 | 99.5 | 0.5 | $8 \times 10^{-4}$ | 1.5 | 210 | 2.53 | 0.04 |
| 12-14 | 99.5 | 0.5 | $1.6 \times 10^{-3}$ | 1.5 | 210 | 2.53 | 0.03 |
| 12-15 | 99.5 | 0.5 | $3.2 \times 10^{-3}$ | 1.5 | 210 | 2.53 | 0.03 |
| 12-16 | 99.5 | 0.5 | $6 \times 10^{-3}$ | 1.5 | 210 | 2.52 | 0.03 |
| 12-17 | 99.5 | 0.5 | $8.4 \times 10^{-3}$ | 1.5 | 210 | 2.50 | 0.03 |
| 12-18 | 99.5 | 0.5 | $1.0 \times 10^{-2}$ | 1.5 | 210 | 2.50 | 0.02 |
| 12-19 | 99.5 | 0.5 | $1.2 \times 10^{-2}$ | 1.5 | 210 | 2.48 | 0.02 |
| 12-20 | 99.5 | 0.5 | $1.5 \times 10^{-2}$ | 1.5 | 210 | 2.46 | 0.02 |
| 12-21 | 99.5 | 0.5 | $6 \times 10^{-3}$ | 0 | 210 | 1.82 | 0.02 |
| 12-22 | 99.5 | 0.5 | $6 \times 10^{-3}$ | 0.1 | 210 | 1.96 | 0.02 |
| 12-23 | 99.5 | 0.5 | $6 \times 10^{-3}$ | 0.3 | 210 | 2.39 | 0.02 |
| 12-24 | 99.5 | 0.5 | $6 \times 10^{-3}$ | 0.5 | 210 | 2.46 | 0.02 |
| 12-25 | 99.5 | 0.5 | $6 \times 10^{-3}$ | 0.7 | 210 | 2.50 | 0.03 |
| 12-26 | 99.5 | 0.5 | $6 \times 10^{-3}$ | 1.5 | 210 | 2.52 | 0.03 |
| 12-27 | 99.5 | 0.5 | $6 \times 10^{-3}$ | 2.0 | 210 | 2.52 | 0.03 |
| 12-28 | 99.5 | 0.5 | $6 \times 10^{-3}$ | 3.5 | 210 | 2.53 | 0.03 |
| 12-29 | 99.5 | 0.5 | $6 \times 10^{-3}$ | 5 | 210 | 2.53 | 0.03 |
| 12-30 | 99.5 | 0.5 | $6 \times 10^{-3}$ | 10 | 210 | 2.55 | 0.03 |
| 12-31 | 99.5 | 0.5 | $6 \times 10^{-3}$ | 15 | 210 | 2.56 | 0.04 |
| 12-32 | 99.5 | 0.5 | $6 \times 10^{-3}$ | 1.5 | 45 | 1.46 | 0.01 |
| 12-33 | 99.5 | 0.5 | $6 \times 10^{-3}$ | 1.5 | 70 | 1.69 | 0.02 |
| 12-34 | 99.5 | 0.5 | $6 \times 10^{-3}$ | 1.5 | 90 | 2.41 | 0.02 |
| 12-35 | 99.5 | 0.5 | $6 \times 10^{-3}$ | 1.5 | 100 | 2.43 | 0.02 |
| 12-36 | 99.5 | 0.5 | $6 \times 10^{-3}$ | 1.5 | 120 | 2.45 | 0.02 |
| 12-37 | 99.5 | 0.5 | $6 \times 10^{-3}$ | 1.5 | 150 | 2.49 | 0.03 |
| 12-38 | 99.5 | 0.5 | $6 \times 10^{-3}$ | 1.5 | 210 | 2.52 | 0.03 |
| 12-39 | 99.5 | 0.5 | $6 \times 10^{-3}$ | 1.5 | 240 | 2.53 | 0.03 |
| 12-40 | 99.5 | 0.5 | $6 \times 10^{-3}$ | 1.5 | 300 | 2.56 | 0.04 |
| 12-41 | 99.5 | 0.5 | $6 \times 10^{-3}$ | 1.5 | 360 | 2.58 | 0.05 |

As indicated in Table 7, when the composition of silver halide, color developing time and the concentrations of bromide and benzyl alcohol are a preferable range of this invention, a sufficient density of yellow dyes and a sufficiently lowered magenta fogging were obtained even if a heavy metal is contained in the developer.

EXAMPLE 13

Experiments the same as Example 13 were carried out except that the magenta coupler M(1) in the color paper sample, which were used in Experiments No. $12^{-1}$ to $12^{-8}$, was changed by hydrazotriazole type magenta couplers M'-1 to M'-7, respectively. The maximum of yellow density was about the same as those in Experiments No. 12-1 to 12-8 and the density of magenta dye in the unexposed are was improved to 0.01, which means a very favorable result.

EXAMPLE 14

Experiments were carried out in the manner similar to that of Example 12 except that the use of hydroxylamine sulfate in the color developer was changed to the same concentration of the exemplified compounds of hydroxylamine derivertives indicated by the Formula (I), A-1, A-13, A-18, A-21 and A-7. the maximum yellow density was increased area about 0.1 and the magenta density in the unexposed area decreased by 0.02 to 0.01. The formation of tarry substance was also decreased.

EXAMPLE 15

Experiments were carried out in the manner similar to that of Example 12 except that the exemplified compound of alkanolamine derivative, represented by Formula (D), D-2, D-3, or D-13 were added to the color developer in the amount of 5 g/liter. The maximum of yellow densities were increased about 0.15 and the magenta dye densities in unexposed areas were decreased to 0.02. The formation of tarry substance and crystalline substance were also improved.

EXAMPLE 16

Experiments were carried out in the manner similar to that of Example 12 except that heterocyclic mercapto compounds I-24, I-41, I-60, I-66, I-79 and I-84 in the amount of 0.12 mg/m$^2$ were each added into each emulsion layer of color paper samples the same as used in Experiments No. 12-1 to 12-8. The maximum of yellow densities were not changed and the magenta fog densities were decreased by 0.02 to 0.01.

What is claimed is:

1. A method for processing a silver halide color photographic light-sensitive material comprising a step for developing with a color developer an imagewise exposed silver halide color photographic light-sensitive material which comprises a support and a photographic layer being provided on said support and including at least one silver halide emulsion layer, wherein said photographic layer has a swelling ratio within the range of from 1.5 to 3.5 and said silver halide emulsion layer comprises a silver halide emulsion having a silver chloride content of not less than 90 mole %, and said developing step is performed for a time of not less than 90 seconds with a color developer containing a compound represented by the following Formula (1):

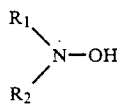

(1)

wherein $R_1$ and $R_2$ are each a hydrogen atom or an alkyl group provided that $R_1$ and $R_2$ are not hydrogen atoms at the same time, and $R_1$ and $R_2$ may be combined to form a ring.

2. The method of claim 1, wherein said color developer contains a bromide in an amount of not less than $4\times10^{-4}$ mole/l.

3. The method of claim 2, wherein said color developer contains said bromide in an amount of from $8\times10^{-4}$ mole/l to $1.2\times10^{-2}$ mole/l.

4. The method of claim 1, wherein said color developer contains benzyl alcohol in an amount of from 0.3 g/l to 10 g/l.

5. The method of claim 1, wherein said color developer contains a bromide in an amount of not less than $4\times10^{-4}$ mole/l and benzyl alcohol of 0.3 g/l to 10 g/l.

6. The method of claim 1, wherein said color developer contains a compound represented by the following Formula (D):

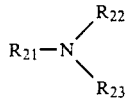

(D)

wherein $R_{21}$ is a hydroxyalkyl group having 2 to 6 carbon atoms; and $R_{22}$ and $R_{23}$ are each a hydrogen atom, an alkyl group having 1 to 6 carbon atoms; a hydroxy alkyl group having 2 to 6 carbon atoms; a benzyl group or a

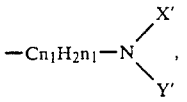

in which $n_1$ is an integer of from 1 to 6, X' and Y' are each a hydrogen atom, an alkyl group having 2 to 6 carbon atoms or a hydroxyalkyl group.

7. The method of claim 1, wherein said developing step is performed for a time of from 100 seconds to 360 seconds.

8. The method of claim 1, wherein said process contains a step for bleach-fixing said light-sensitive material with a bleach-fixer after said developing step and said bleach-fixer is replenished with a replenisher in an amount of not more than 200 ml per $m^2$ of said light-sensitive material to be bleach fixed.

9. The method of claim 8, wherein said bleach-fixer is replenished with said replenisher in an amount of from 10 ml to 200 ml per m of said light-sensitive material to be bleach-fixed.

10. The method of claim 1, wherein said swelling ratio is from 2.0 to 3.2.

11. The method of claim 1, wherein said silver chloride content is 95 mole %.

12. The method of claim 1, wherein said photographic layer contains a nitrogen-containing heterocyclic mercapto compound.

13. The method of claim 1, wherein at least one silver halide emulsion layer included said photographic layer contains a magenta coupler represented by the following formula M-1:

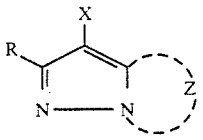

(M-I)

wherein Z represents an atomic group necessary for forming a nitrogen-containing heterocyclic ring which may have a substituent; R repressents a hydrogen atom or a substituent group and X represents a hydrogen atom or a group capable of being split off upon reaction with the oxidation product of a color developing agent.

14. The method of claim 6 wherein said color developer contains a bromide in an amount of not less than $4\times10^{-4}$ mole/and benzyl alcohol in an amount of 0.3 g/l to 10 g/l.

15. The method of claim 14 wherein said swelling ratio is from 2.0 to 3.2 and said silver chloride content is 95 mole %.

16. The method of claim 13 wherein said color developer contains a bromide in an amount of not less than $4\times10^{-4}$ mole/and benzyl alcohol in an amount of 0.3 g/l to 10 g/l.

17. The method of claim 16 wherein said swelling ratio is from 2.0 to 3.2 and said silver chloride content is 95 mole %.

* * * * *